US008836624B2

(12) United States Patent
Roberts et al.

(10) Patent No.: US 8,836,624 B2
(45) **Date of Patent: *Sep. 16, 2014**

(54) PARTIALLY FILTERLESS AND TWO-COLOR SUBPIXEL LIQUID CRYSTAL DISPLAY DEVICES, MOBILE ELECTRONIC DEVICES INCLUDING THE SAME, AND METHODS OF OPERATING THE SAME

(75) Inventors: John Roberts, Grand Rapids, MI (US); Chenhua You, Cary, NC (US)

(73) Assignee: Cree, Inc., Durham, NC (US)

( * ) Notice: Subject to any disclaimer, the term of this patent is extended or adjusted under 35 U.S.C. 154(b) by 1092 days.

This patent is subject to a terminal disclaimer.

(21) Appl. No.: 11/847,882

(22) Filed: Aug. 30, 2007

(65) Prior Publication Data

US 2008/0198114 A1 Aug. 21, 2008

Related U.S. Application Data

(63) Continuation-in-part of application No. 11/675,250, filed on Feb. 15, 2007.

(51) Int. Cl.
*G09G 3/36* (2006.01)

(52) U.S. Cl.
USPC ..... 345/88; 345/102

(58) Field of Classification Search
USPC ..... 345/87–100, 204–215
See application file for complete search history.

(56) References Cited

U.S. PATENT DOCUMENTS 6,037,921 A * 3/2000 Matsumoto et al. ..... 345/88
7,551,204 B2 * 6/2009 Muraki ..... 348/222.1

(Continued)

FOREIGN PATENT DOCUMENTS

EP 0875880 A2 11/1998
EP 1202244 A1 5/2002

(Continued)

OTHER PUBLICATIONS

Notification of Transmittal of the International Search Report and the Written Opinion of the International Searching Authority, or the Declaration corresponding to International Application No. PCT/US2008/001825 mailed Jun. 12, 2008.

(Continued)

*Primary Examiner* — Vijay Shankar
(74) *Attorney, Agent, or Firm* — Myers Bigel Sibley & Sajovec, PA

(57) ABSTRACT

A liquid crystal display (LCD) device includes a pixel array including a plurality of pixels configured to display an image. The plurality of pixels respectively include a first subpixel configured to display first color image data, and a second subpixel configured to display second and third color image data. The LCD device may further include a backlight configured to emit the first, second, and/or third colors of light, and a backlight controller. The backlight controller may be configured to activate the backlight to emit the first and second colors of light at a same time to generate a first image component including a combination of the first color image data and the second color image data, and to separately emit the third color of light at a different time than the first and second colors of light to generate a second image component including the third color image data. The pixel array may be configured to display the first and second image components to provide a single image frame. Related devices and methods of operation are also discussed.

20 Claims, 13 Drawing Sheets

(56) References Cited

U.S. PATENT DOCUMENTS

| | | | | |
|---|---|---|---|---|
| 7,852,313 | B2 * | 12/2010 | Sekiguchi | 345/102 |
| 7,952,544 | B2 * | 5/2011 | Roberts | 345/87 |
| 2002/0075224 | A1 | 6/2002 | Son | |
| 2005/0140636 | A1 | 6/2005 | Chung et al. | |
| 2006/0007105 | A1 | 1/2006 | Chen et al. | |
| 2006/0055658 | A1 | 3/2006 | Drader et al. | |
| 2006/0221044 | A1 * | 10/2006 | Negley et al. | 345/102 |
| 2006/0232545 | A1 * | 10/2006 | Sekiguchi | 345/102 |
| 2010/0110114 | A1 * | 5/2010 | Hashimoto | 345/691 |

FOREIGN PATENT DOCUMENTS

| | | | |
|---|---|---|---|
| EP | 1715473 | A2 | 10/2006 |
| JP | 2000-028984 | A | 1/2000 |
| JP | 2000-171787 | A | 6/2000 |
| JP | 2002-149129 | A | 5/2002 |
| JP | 2004-086081 | A | 3/2004 |
| JP | 2005-346042 | A | 12/2005 |
| JP | 2006-164631 | A | 6/2006 |
| JP | 2006-301043 | A | 11/2006 |
| WO | WO 03/075617 | A1 | 9/2003 |

OTHER PUBLICATIONS

IBM Corp. "Brightness and Color Temperature Control on Thin Film Transistor/Liquid Crystal Display", *IBM Technical Disclosure Bulletin* 40(8):27 (1997).

Invitation to Pay Additional Fees and, Where Applicable, Protest Fee corresponding to International Application No. PCT/US2008/002068 mailed Jun. 20, 2008.

Japanese Office Action Corresponding to Japanese Application No. 2009-549606; Mailing Date: Jan. 17, 2012; 12 pages.

Japanese Office Action Corresponding to Japanese Patent Application No. 2009-549606; Mailing Date: Feb. 5, 2013; Foreign Text, 8 Pages, English Translation Thereof, 7 Pages.

European Summons to Attend Oral Proceedings Pursuant to Rule 115(1) EPC Corresponding to European Application No. 08725452.0; Date: Jan. 18, 2013; 11 Pages.

Communication Pursuant to Article 94(3) EPC, European Application No. 08 725 676.4, Jun. 26, 2013.

"New LCD Wide-Angle-View Technology", *Pen Reader Q&A* (2 pages), Feb. 15, 2007.

* cited by examiner

PARTIALLY FILTERLESS AND TWO-COLOR SUBPIXEL LIQUID CRYSTAL DISPLAY DEVICES, MOBILE ELECTRONIC DEVICES INCLUDING THE SAME, AND METHODS OF OPERATING THE SAME

CROSS-REFERENCE TO RELATED APPLICATIONS

The present application is a continuation-in-part of and claims priority from U.S. patent application Ser. No. 11/675,250, filed Feb. 15, 2007, the disclosure of which is incorporated by reference herein in its entirety.

FIELD OF THE INVENTION

The present invention relates to liquid crystal display devices and methods of operating the same.

BACKGROUND OF THE INVENTION

A liquid crystal display (LCD) device is a relatively thin, flat display device made up of a number of color or monochrome pixels arrayed in front of a light source or reflector. For example, an LCD device may include an LCD screen including a pixel array, and a backlight arranged behind the LCD screen such that the pixel array is positioned to receive light emitted by the backlight. In a full-color LCD device, each pixel of the pixel array may include three subpixels configured to display red, green, and blue light, respectively. More particularly, each subpixel may include a liquid crystal shutter and a color filter configured to display one of the three (red, green, or blue) colors of light. In order to form an image, the shutters of the subpixels may be opened for differing time intervals in each refresh cycle, and the corresponding color filters may display their respective colors when the shutters are opened. The length of the time interval in which each shutter is opened may determine the intensity of the color displayed in the subpixel, and the combination of the red, green, and blue colors may provide a full-color pixel. An array of full-color pixels may be used to generate a full-color image.

FIG. 1 schematically illustrates a conventional LCD display device 100. As shown in FIG. 1, the display device 100 includes a backlight 102 and an LCD screen 105. The backlight 102 is configured to emit light having a white or near-white color, which may be used to illuminate the LCD screen 105. The LCD screen 105 includes an array of red, green, and blue (RGB) color filters 130, and a corresponding array of liquid crystal shutters 120. The red color filter 130*r* is configured to allow passage of red light, but prevent passage of green and blue light. Similarly the green color filter 130*g* and the blue color filter 130*b* are configured to allow passage of green and blue light, respectively, and prevent passage of other colors of light. The liquid crystal shutters 120 are controlled by a shutter controller 110. Each group of red, green, and blue color filters 130 and the corresponding liquid crystal shutters 120 are arranged to form four pixels 115*a*-115*d*. In each display cycle, the shutter controller 110 is configured to selectively open the liquid crystal shutters 120 for predetermined periods of time to combine the red, green, and/or blue light provided by the color filters 130 such that each pixel 115*a*-115*d* displays a desired color at a desired brightness level.

SUMMARY OF THE INVENTION

According to some embodiments of the present invention, a liquid crystal display (LCD) device includes a pixel array including a plurality of pixels configured to display an image. The plurality of pixels respectively include a first subpixel configured to display first color image data, and a second subpixel configured to display second and third color image data. For example, the second subpixel may be configured to sequentially display the second and third color image data.

In some embodiments, the first subpixel may include a first liquid crystal shutter configured to be activated to an open state in the closed state, and a first color filter configured to allow passage of a first color like to prevent passage of a second color of light. The second subpixel may include a second liquid crystal shutter configured to be activated to an open state and a closed state, and a second color filter configured to allow passage of the second color of light and a third color of light and prevent passage of the first color of light.

In other embodiments, the first color filter may be further configured to allow passage of the third color of light. As such, the first subpixel may be configured to display the first and the third color image data. For example, the first subpixel may be configured to sequentially display the first and third color image data.

In some embodiments, the LCD device may further include a backlight configured to emit the first, second, and/or third colors of light, and a backlight controller. The backlight controller may be configured to activate the backlight to emit the first and second colors of light at a same time to generate a first image component including a combination of the first color image data and the second color image data. The backlight controller may be further configured to activate the backlight to separately amidst the third color of light at a different time than the first and second colors of light to generate a second image component including the third color image data. The pixel display may be configured to sequentially display the first and second image components to provide a single image frame.

In other embodiments, the LCD device may further include a shutter controller coupled to the pixel array. The shutter controller to be configured to selectively activate the first and second liquid crystal shutters when the backlight is activated to emit the first and second colors of light to display the first color image data and the second color image data at the same time to generate the first image component. The shutter controller may also be configured to selectively activate at least the second liquid crystal shutter when the backlight is activated to separately emit the third color of light to separately display the third color image data at a different time to generate the second image component.

In some embodiments, the backlight controller may be configured to alternately activate the backlight to emit the first and second colors of light at the same time and activate the backlight to emit the third color of light at a different time than the first and second colors of light to sequentially display the first and second image components at a predetermined refresh rate. The predetermined refresh rate may be based on a shutter rate of the first and/or second of liquid crystal shutters In other embodiments, the backlight controller may be configured to activate the backlight to emit the first and second colors of light during a first time period. The same time may be at least a portion of the first time period. In addition, the backlight controller may be configured to activate the backlight to emit the third color lights during a second time period. A duration of the second time period may be different than that of the first time period.

In some embodiments, the backlight controller may be configured to activate the backlight to emit the first color of light during a first portion of the first time period, and emit the second color of light during a second portion of the first time period. The first and second portions of the first time period may have different durations, but may respectively include the same time.

In other embodiments, the backlight may be a solid state lighting panel including a first solid state lighting element configured to emit the first color of light, a second solid state lighting element configured to emit the second color of light, and a third solid state lighting element configured to emit the third color of light. The backlight controller may be configured to activate the first and second solid state lighting elements at the same time to generate the first image component, and may be configured to activate the third solid state lighting element at a different time than the first and second solid state lighting elements to generate the second image component.

In some embodiments, the first, second, and/or third solid-state lighting elements may be a light emitting diode (LED), organic light emitting diode (OLED), and/or a laser light source.

In other embodiments, a wavelength of the third color of light may be greater than a wavelength of the second color of light but less than a wavelength of the first color of light. For example, the first color of light may be red light, the second color of light may be blue light, and the third color of light may be green light. Also, the first color of light may be magenta light, the second color of light may be cyan light, and the third color of light may be yellow light.

According to other embodiments of the present invention, a screen for use in a liquid crystal display (LCD) device includes a pixel array. The pixel array includes a plurality of pixels configured to display an image. The plurality of pixels respectively include a first subpixel configured to display first color image data, and a second subpixel configured to display second and third color image data.

In some embodiments, the first subpixel may include a first liquid crystal shutter configured to be activated to an open state in the closed state, and a first color filter configured to allow passage of a first color like to prevent passage of a second color of light. The second subpixel may include a second liquid crystal shutter configured to be activated to an open state and a closed state, and a second color filter configured to allow passage of the second color of light and a third color of light and prevent passage of the first color of light.

In other embodiments, the first color filter may be further configured to allow passage of the third color of light. As such, the first subpixel may be configured to display the first and the third color image data.

In some embodiments, the screen may include a shutter controller. The shutter controller may be configured to selectively activate the first and second liquid crystal shutters to display the first color image data and the second color image data at a same time to generate a first image component including a combination of the first color image data and the second color image data. The shutter controller may further be configured to selectively activate at least the second of the crystal shutter separately display the third color image data at a different time than the first and second color image data to generate a second image component including the third color image data. The pixel array may be configured to sequentially display the first and second image components to provide the image.

In other embodiments, the first color filter may be configured to prevent passage of the third color of light.

In some embodiments, a wavelength of the third color of light may be greater than a wavelength of the second color of light, but less than a wavelength of the first color of light.

According to further embodiments of the present invention, a solid state lighting panel includes a first solid-state lighting element configured to emit light of a first color, a second solid-state lighting element configured to emit light of a second color, a third solid-state lighting element configured to emit light of a third color, and a lighting controller. The lighting controller is configured to activate the first and second solid-state lighting elements at a same time to generate a first image component including a combination of image data of the first and second colors. The lighting controller is also configured to activate the third solid-state lighting element at a different time than the first and second solid-state lighting elements to generate a second image component including image data of the third color. The first and second image components are configured to be displayed to provide a single image frame.

In some embodiments, the lighting controller may be further configured to alternate between activating the first and second solid-state lighting elements and activating the third solid-state lighting elements at a predetermined frequency to sequentially display the first and second image components at a predetermined refresh rate.

In other embodiments, the lighting controller may be configured to activate the first and second lighting elements during a first time period. The same time may be at least a portion of the first time period. In addition, the lighting controller may be configured to activate the third lighting element during a second time period. A duration of the second time period may be different than that of the first time period. Also, the lighting controller may be configured to activate the first and second lighting elements for different portions of the first time period that respectively include the same time.

In some embodiments, the first, second, and/or third solid state lighting elements may be light-emitting diodes (LEDs), organic light-emitting diode (OLEDs), and/or laser light sources.

In some embodiments, the third solid state lighting element may be configured to emit light having a wavelength that is between the wavelengths of the light emitted by the first and second solid state lighting elements. For example, the third solid state lighting element may be configured to emit green light, the first solid state lighting element may be configured to emit red light, and the second solid state lighting element may be configured to emit blue light. Also, the third solid state lighting element may be configured to emit yellow light, the first solid state lighting element may be configured to emit magenta light, and the second solid state lighting element may be configured to emit cyan light.

According to still further embodiments of the present invention, a method for operating a liquid crystal display (LCD) device including a backlight and a pixel array includes activating the backlight to emit first and second colors of light at a same time to generate a first image component including a combination of first color image data and second color image data, and activating the backlight to separately emit a third color of light at a different time than the first and second colors of light to generate a second image component including third color image data. The pixel array is a activated to display the first and second image components to provide a single image for In some embodiments, the pixel array may include a plurality of pixels respectively including a first subpixel configured to display the first color image data in a second something so configured to display the second and the third color image data. The first and second subpixels may be selectively activated concurrently with activating the backlight to emit the first and second colors of light to display the first image component. The first and second subpixels may also be selectively activated concurrently with activating the backlight to emit a third color of light to display the second image component.

In other embodiments, include first, second, and third solid-state lighting elements respectively configured to emit light of the first, second, and third colors. The first and second solid-state lighting elements may be activated at the same time to generate the first image component, and the third solid-state lighting element may be activated at a different time than the first and second solid-state lighting elements to generate the second image component.

In some embodiments, the backlight may be activated to emit the first and second colors of lights during a first time period. The same time may be at least a portion of the first time period. The backlight may be activated to emit the first and second colors of light for different portions of the first time period that respectively include the same time. In addition, the backlight may be activated to emit the third color of lights during a second time period. A duration of the second time period may be different than that of the first time period.

In other embodiments, activation of the backlight to limit the first and second colors of light may be alternated with activation of the backlight and the third color of light based on a shutter rate of the first/or second subpixels.

According to still further embodiments of the present invention, a mobile electronic device includes a lighting device, a lighting controller, a screen, and a battery. The lighting device is configured to emit first, second, and/or third colors of light. The lighting controller is configured to activate the lighting device to emit the first and second colors of light at a same time to generate a first image component including a combination of first color image data and second color image data, and to separately emit the third color of light at a different time than the first and second colors of light to generate a second image component including third color image data. The screen is configured to display the first and second image components to provide a single image frame. The battery is electrically coupled to the lighting device and the screen and is configured to provide power thereto.

In some embodiments, the screen may include a pixel array including a plurality of pixels configured to display the image frame. The plurality of pixels may respectively include first and second sub pixels. The first subpixel may be configured to display first color image data, and may include a first liquid crystal shutter configured to be activated to an open state and a closed state and a first color filter configured to allow passage of a first color of light and prevent passage of a second color of light. The second subpixel may be configured to display second and third color image data, and may include a second liquid crystal shutter configured to be activated to an open state and a closed state and a second color filter configured to allow passage of the second color of light and a third color of light and prevent passage of the first color of light. In some embodiments, the first subpixel may be configured to display the first and the third color image data, and the first color filter may be further configured to allow passage of the third color of light.

In other embodiments, the screen may include a pixel array including a plurality of pixels configured to display the image frame. The plurality of pixels may respectively include first, second, and third sub pixels. The first subpixel may be configured to display first color image data, and may include a first liquid crystal shutter configured to be activated to an open state and a closed state, and a first color filter configured to allow passage of a first color of light and prevent passage of a second color of light. The second subpixel may be configured to display second color image data, and may include a second liquid crystal shutter configured to be activated to an open state and a closed state, and a second color filter configured to allow passage of the second color of light and prevent passage of the first color of light. The third subpixel may be configured to display third color image data, and may include a third liquid crystal shutter configured to be activated to an open state and a closed state. The third subpixel may not include a color filter.

In some embodiments, the mobile electronic device may further include a shutter controller. The shutter controller may be configured to selectively activate the first and second liquid crystal shutters to the open state and activate the third liquid crystal shutter to the closed state when the lighting device is activated to emit the first and second colors of light to generate the first image component, and may be configured to selectively activate the third liquid crystal shutter to the open state when the lighting device is activated to separately emit the third color of light to generate the second image component.

In some embodiments, the lighting device may be an edge backlight. In other embodiments, the lighting device may be a direct backlight. In some embodiments, the lighting device may be configured to provide a luminance greater than about 100 Nit and/or a luminance-to-power ratio of greater than about 20 Nit per Watt, for example, for a 15-inch laptop display.

In other embodiments, the mobile electronic device may further include an optical sensor and a compensation units coupled to the optical sensor. The optical sensor may be configured to detect ambient light, and the compensation units may be configured to control the power provided the lighting device based on the detected ambient light. For example, the optical sensor may be configured to sample ambient light levels when the lighting device is not activated to emit the first and second colors of light at the same time or the third color of light at the different time. In some embodiments, the optical sensor may be configured to generate a feedback signal to provide closed loop control of the luminance, chromaticity, and/or color temperature of the light emitted by the lighting device.

DETAILED DESCRIPTION OF EMBODIMENTS OF THE INVENTION

Figure 1:
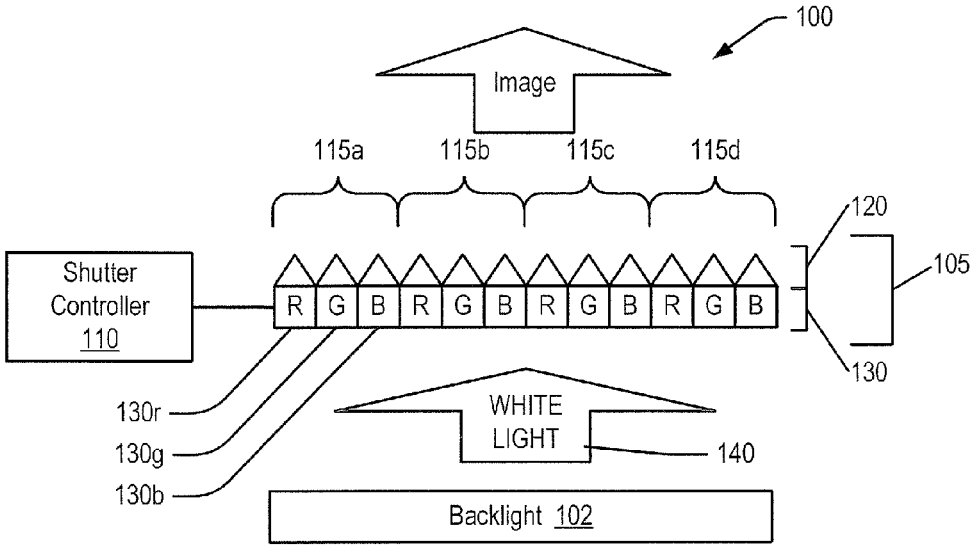
FIG. 1 (PRIOR ART)
FIG. 1 is a block diagram illustrating a conventional LCD device.

The present invention now will be described more fully hereinafter with reference to the accompanying drawings, in which embodiments of the invention are shown. However, this invention should not be construed as limited to the embodiments set forth herein. Rather, these embodiments are provided so that this disclosure will be thorough and complete, and will fully convey the scope of the invention to those skilled in the art. In the drawings, the thicknesses of layers and/or regions are exaggerated for clarity. Like numbers refer to like elements throughout.

It will be understood that, although the terms first, second, third, etc. may be used herein to describe various elements, these elements should not be limited by these terms. These terms are only used to distinguish one element from another. For example, a first element could be termed a second element, and, similarly, a second element could be termed a first element, without departing from the scope of the present invention.

The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The present invention is described below with reference to flowchart illustrations and/or block and/or flow diagrams of methods, devices, and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block and/or flow diagram block or blocks.

These computer program instructions may also be stored in a computer-readable memory that can direct a computer or other programmable processor to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processor to cause a series of operational steps to be performed on the computer or other programmable processor to produce a computer implemented process such that the instructions which execute on the computer or other programmable processor provide steps for implementing the functions or acts specified in the flowchart and/or block diagram block or blocks. It should also be noted that in some alternate implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

Unless otherwise defined, all terms used in disclosing embodiments of the invention, including technical and scientific terms, have the same meaning as commonly understood by one of ordinary skill in the art to which this invention belongs, and are not necessarily limited to the specific definitions known at the time of the present invention being described. Accordingly, these terms can include equivalent terms that are created after such time. It will be further understood that terms, such as those defined in commonly used dictionaries, should be interpreted as having a meaning that is consistent with their meaning in the present specification and in the context of the relevant art and will not be interpreted in an idealized or overly formal sense unless expressly so defined herein. All publications, patent applications, patents, and other references mentioned herein are incorporated by reference in their entirety.

Some embodiments of the present invention provide devices and methods for sequentially displaying first and second image components to provide a single full-color image using an LCD device including filters of two colors, but no filter of the third color. For example, some backlights may be configured to separately emit red, green, and blue light in sequence to provide red, green, and blue color image data, which may be perceived as a full-color image by a viewer. As such, an LCD display may be provided without the use of one or more color filters by coordinating the opening of the red, green, and blue liquid crystal shutters of the display with the activation of the desired color in the backlight. As a color filter may inadvertently block at least some portion of a desired color of light near the cutoff wavelength of the color filter, removal of one or more color filters may reduce losses that may affect the brightness and/or efficiency of the display. For example, in some embodiments of the present invention, the LCD device may include red and blue color filters, but no green color filters. Since green may dominate the luminance of a display, removal of the green color filters in LCD devices according to some embodiments of the present invention may provide improved brightness and/or efficiency. In addition, as the color filters may represent a significant portion of the overall cost of an LCD device, LCD devices according to some embodiments of the present invention may allow for reduced production costs as compared to conventional LCD devices.

Figure 2A:
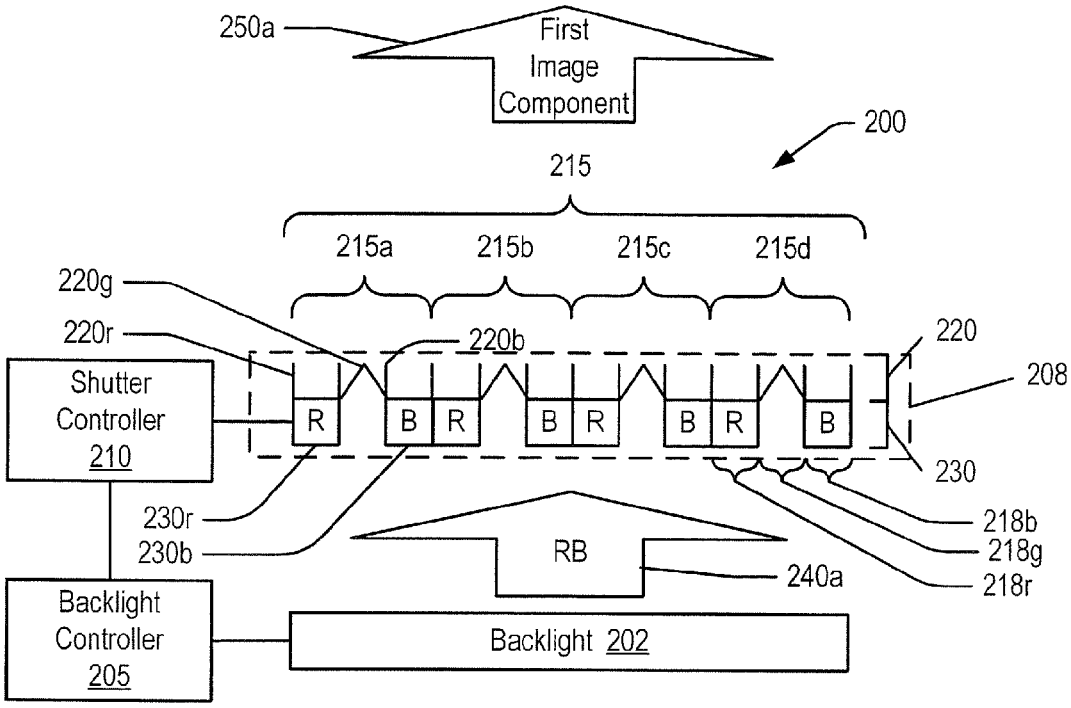
FIGS. 2A and 2B are block diagrams illustrating LCD devices and methods of operation according to some embodiments of the present invention.
Figure 2B:
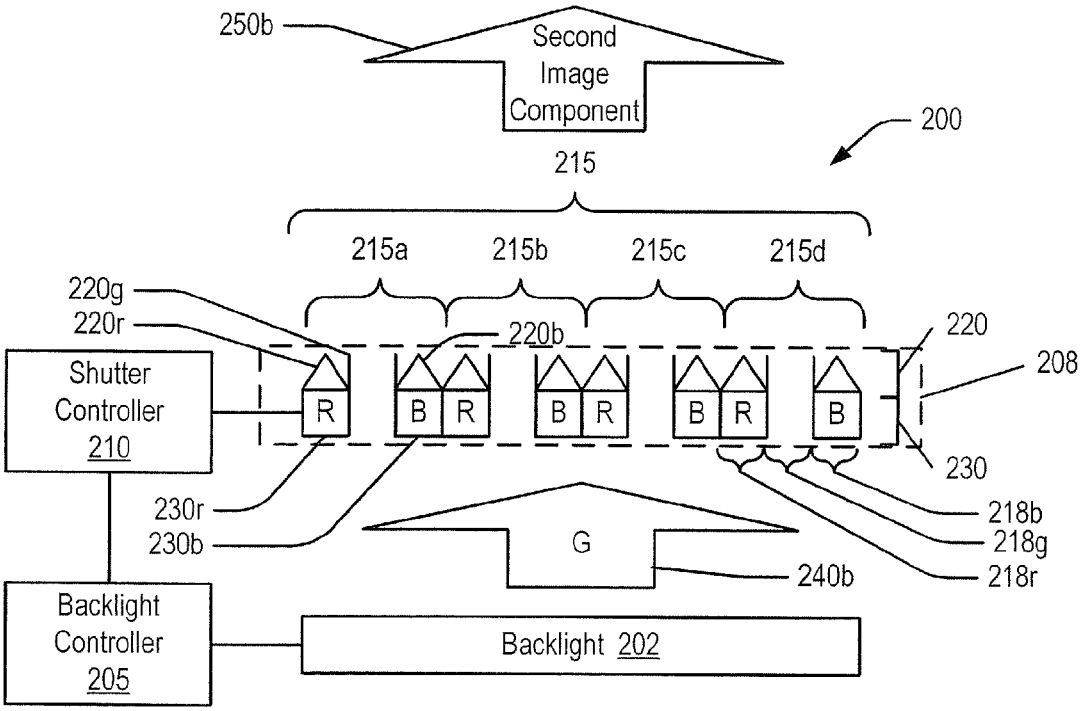

FIGS. 2A and 2B illustrate an LCD device 200 and methods of operation according to some embodiments of the present invention. Referring now to FIGS. 2A and 2B, the LCD device 200 includes a backlight 202 and an LCD screen 208. The backlight 202 is configured to emit first, second, and/or third colors of light, sequentially and/or simultaneously. More particularly, the backlight 202 is configured to emit red, green, and/or blue light. The LCD screen 208 includes a pixel array 215 including a plurality of pixels 215*a*-215*d*. Each of the pixels 215*a*-215*d* includes first, second, and third subpixels 218*r*, 218*b*, and 218*g*, configured to display red, blue, and green color image data, respectively. Each of the subpixels 218*r*, 218*b*, and 218*g* includes a liquid crystal shutter 220. The liquid crystal shutter 220 is configured to transmit light based on an applied voltage across a liquid crystal material therein. As such, based on the applied voltage, the liquid crystal shutter 220 may be activated to an open state and a closed state to display a particular color of light. In addition, some of the subpixels 218*r* and 218*b* include color filters 230 configured to allow passage of a first color of light, and prevent passage of second and third colors of light.

More particularly, as shown in FIGS. 2A and 2B, the subpixel 218*r* includes a red color filter 230*r* configured to allow passage of red light and prevent passage of blue and green light, and a liquid crystal shutter 220*r* configured to be activated to an open state and a closed state to display the red color image data. Similarly, the subpixel 218*b* includes a blue color filter 230*b* configured to allow passage of blue light and prevent passage of red and green light, and a liquid crystal shutter 220*b* configured to be activated to an open state and a closed state to display the blue color image data. The subpixel 218*g* also includes a liquid crystal shutter 220*g* configured to be activated to an open state and a closed state; however, the subpixel 218*g* does not include a color filter. As such, the liquid crystal shutter 220*g* is configured to be selectively activated to perform a filtering function, i.e., to allow passage of green light and prevent passage of red and/or blue light to display the green color image data.

Accordingly, the shutters 220 and the backlight 202 may be selectively activated to display the red, blue, and green color image data to provide a full-color image. More particularly, as shown in FIGS. 2A and 2B, the LCD device 200 includes a backlight controller 205 coupled to the backlight 202 and a shutter controller 210 coupled to the LCD screen 208. The backlight controller 205 is configured to activate the backlight 202 to simultaneously emit two colors of light to generate a first image component, and to emit a third color of light separately from the first and second colors of light to generate a second image component. More particularly, the backlight controller 205 may be configured to activate the backlight 202 to separately emit the third color of light at a different time than the first color of light. However, it is to be understood that there may be some negligible overlap between the time of emission of the third color of light and the time of emission of the first and second colors of light. As such, the first image component includes a combination of color image data for the two colors of light, and the second image component includes color image data for the third color of light. In addition, the shutter controller 210 is configured to selectively activate two liquid crystal shutters 220*r* and 220*b* of each pixel to the open state and activate the third liquid crystal shutter 220*g* to the closed state to generate the first image component, and to selectively activate the third liquid crystal shutter 220*g* of each pixel to the open state to generate the second image component. The first and second image components may be sequentially displayed by the LCD device 200 to provide a single full-color image frame.

More particularly, as shown in FIG. 2A, the backlight controller 205 activates the backlight 202 to simultaneously emit both red and blue light 240*a*. For example, the backlight 202 may include a plurality of red, blue, and green light emitting diodes (LEDs), and the backlight controller 205 may be configured to activate the red and blue LEDs substantially simultaneously to emit the red and blue light 240*a*. Also, the shutter controller 210 selectively activates the liquid crystal shutters 220*r* and 220*b* to the open state and activates the liquid crystal shutters 220*g* to the closed state when the backlight 202 is activated to simultaneously emit the red and blue light 240*a*. As such, the closed liquid crystal shutters 220*g* prevent the passage of the red and blue light 240*a* through the subpixels 218*g*, while the open liquid crystal shutters 220*r* and 220*b* and the corresponding red and blue color filters 230*r* and 230*b* allow the passage of red light through the subpixels 218*r* and blue light 240*a* through the subpixels 218*b* to display both red and blue color image data in each of the pixels 215*a*-215*d*. As such, the red color image data and the blue color image data are combined to provide the first image component 250*a*.

In addition, as shown in FIG. 2B, the backlight controller 205 activates the backlight 202 to separately emit green light 240*b* at a different time than the red and blue light 240*a* of FIG. 1, and the shutter controller 210 selectively activates the liquid crystal shutters 220*g* to the open state to allow passage of the green light 240*b* through the subpixels 218*g* when the backlight 202 is activated to emit the green light 240*b*. In other words, the shutter controller 210 selectively activates the liquid crystal shutters 220*g* to allow passage of green light. Since the shutters 220*g* are activated when the backlight 202 is only emitting green light, the subpixel 218*g* can display the green image data without the use of a color filter. The shutter controller 210 may also activate the liquid crystal shutters 220*r* and 220*b* to the closed state when the backlight 202 is activated to emit the green light 240*b* to prevent the passage of green light through the subpixels 218*r* and 218*b*. However, in some embodiments, the liquid crystal shutters 220*r* and/or 220*b* may be activated to the open state when the backlight 202 is activated to emit the green light 240*b*, as the corresponding color filters 230*r* and 230*b* may prevent the passage of green light through the subpixels 218*r* and 218*b*. Thus, the green color image data is displayed in each of the pixels 215*a*-215*d* to provide the second image component 250*b*. Accordingly, the backlight controller 205 and the shutter controller 210 may rapidly alternate between the shutter/backlight configuration illustrated in FIG. 2A and the shutter/backlight configuration illustrated in FIG. 2B to sequentially display the first and second image components 250*a* and 250*b* to provide a single full-color image.

In addition, as the color filters 230*r* and 230*b* may be configured to prevent passage of green light, the backlight controller 205 may be configured to activate the backlight 202 to simultaneously emit red, green, and blue light to generate the first image component 250*a* in some embodiments. In other words, even when the liquid crystal shutters 220*r* and 220*b* are activated to the open state, the color filters 230*r* and 230*b* may prevent any green light emitted by the backlight 202 from being displayed by the subpixels 218*r* and 218*b*. As such, the backlight controller 205 may be configured to activate the backlight 202 to constantly emit the green light 240*b* as shown in FIG. 2B, and may be configured to activate the backlight 202 to alternately emit the red and blue light simultaneously with the green light to provide a single full-color image frame.

Also, the shutter controller 210 may be configured to accelerate a shutter rate of the liquid crystal shutters 220 to provide a predetermined image refresh rate. For example, in order to sequentially display the first image component 250*a* and the second image component 250*b* to provide each image frame, the shutter controller 210 may activate the liquid crystal shutters 220 at double the refresh rate to provide a similar image refresh rate as that of a conventional liquid crystal display, such as the liquid crystal display 100 of FIG. 1. As such, the backlight controller 205 may also be configured to activate the backlight 202 based on the increased shutter rate of the shutters 220. More specifically, as the switching rate of the shutters 220 may be a limiting factor as compared to the switching rate of the backlight 202, the backlight controller 205 may be configured to alternate between activating the backlight 202 to simultaneously emit the red and blue light 240*a* and activating the backlight 202 to separately emit the green light 240*b* based on the switching rate of the shutters 220. In other words, the backlight controller 205 may be configured to activate the backlight 202 to simultaneously emit the red and blue light when the liquid crystal shutters 220*g* are activated to the closed state to generate the first image component 250*a*, and may be configured to activate the backlight 202 to separately emit the green light 240*b* at a different time than the red and blue light when the liquid crystal shutters 220*g* are in the open state to generate the second image component 250*b* to provide each image frame. However, in some embodiments, the shutter controller 210 may not accelerate the switching rates of the liquid crystal shutters 220, and the liquid crystal display 200 may sequentially display the first and second image components 250*a* and 250*b* to provide each image frame at half of the refresh rate of a conventional liquid crystal display, which may also be visibly acceptable.

Although FIGS. 2A and 2B illustrate exemplary liquid crystal display devices and methods of operation according to some embodiments of the present invention, it will be understood that some embodiments of the present invention are not limited to such a configuration, but is intended to encompass any configuration capable of carrying out the operations described herein. For example, although the liquid crystal display device 200 is illustrated as being configured to sequentially display the first image component 250*a* before the second image component 250*b*, it is to be understood that the liquid crystal display device 200 may display the second image component 250*b* prior to the first image component 250*a* to provide each image frame in some embodiments. In addition, although illustrated as simultaneously emitting red and blue light 240*a* and separately emitting green light 240*b*, it is to be understood that the backlight 202 may be configured to emit any two colors of light simultaneously, and may separately emit a remaining third color of light at a different time than the first and second colors of light, or vice versa. Furthermore, although the LCD screen 208 is illustrated as including only red and blue color filters and no green color filter, it is to be understood that the LCD screen 208 may include filters of any two colors, with no filter of the third color. As such, the backlight controller 205 may be configured to activate the backlight 202 to separately emit a color of light corresponding to the missing color filter in the LCD screen 208, and to simultaneously emit the remaining two colors of light. More generally, the backlight 202 and the LCD screen 208 may be activated to provide any two-image component sequence to display a single full-color image frame, where one image component includes only one of red, green, or blue color image data, and where the other image component includes a combination of color image data for the remaining two colors.

Figure 3A:
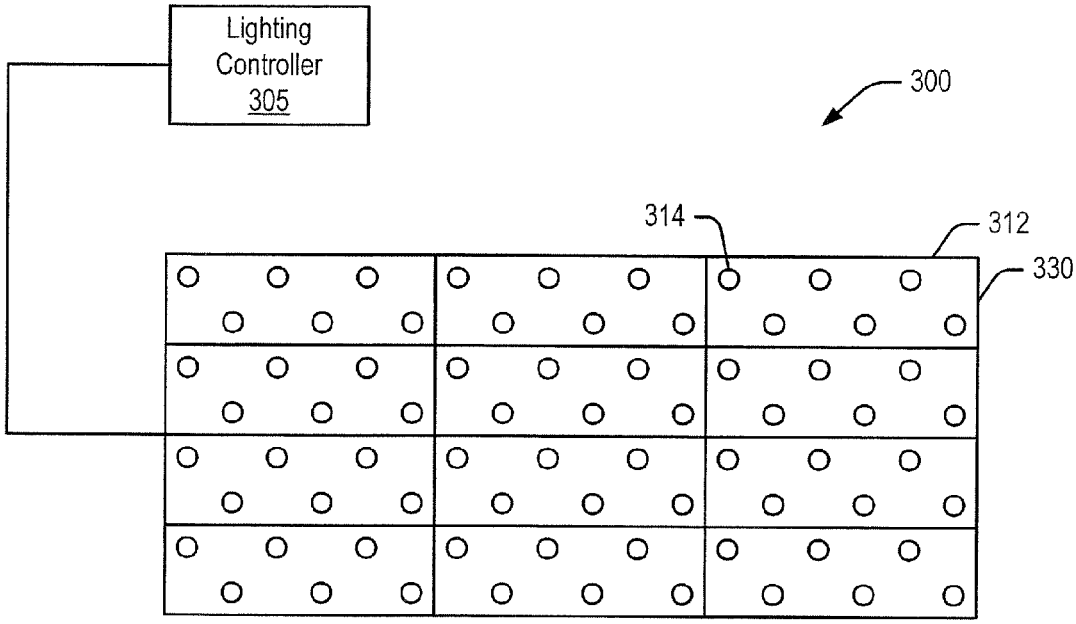
FIGS. 3A to 3C are block diagrams illustrating solid state lighting panels and methods of operation according to some embodiments of the present invention.
Figure 3B:
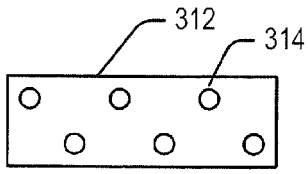
Figure 3C:
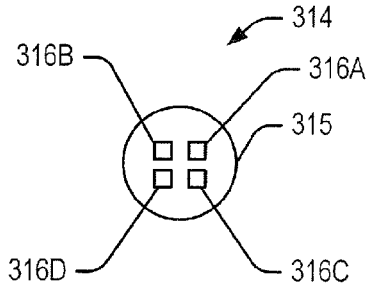

FIGS. 3A to 3C are block diagrams illustrating solid state lighting devices and methods of operation according to some embodiments of the present invention. Referring now to FIG. 3A, a solid state lighting device or lighting panel 300 includes a plurality of solid state lighting tiles 312 mounted in an array. More particularly, a plurality of tiles 312 may be mounted in a linear array to form a bar assembly 330, and a plurality of the bar assemblies 330 may be arranged to form the two-dimensional lighting panel 300. For example, the solid state lighting panel 300 may be used as a backlighting unit in an LCD device, such as the backlight 202 in the LCD device 200 of FIGS. 2A and 2B. As shown in FIG. 3A, the lighting panel 300 may include four bar assemblies, each of which may include three tiles 312; however, fewer or more tiles and/or bar assemblies may be provided in some embodiments of the present invention.

FIG. 3B illustrates a solid state lighting tile 312 according to some embodiments of the present invention. Referring now to FIG. 3B, the tile 312 includes a plurality of solid state lighting devices 314 arranged in a regular and/or irregular pattern on the tile 312. The solid state lighting devices 314 may include, for example, organic light emitting devices (OLEDs), inorganic light emitting diodes (LEDs), and/or laser diodes. The tile 312 may also include other elements (not shown), coupled to the lighting devices 314, such as interconnect lines, electronic circuitry, connectors, test pads, and/or other elements. The tile 312 may include, for example, a printed circuit board (PCB) on which one or more circuit elements may be mounted. Suitable tiles are disclosed and commonly assigned U.S. Provisional Application Ser. No. 60/749,133 entitled "Solid State Backlighting Unit Assembly and Methods" filed Dec. 9, 2005.

FIG. 3C illustrates a solid state lighting device 314 in greater detail. As shown in FIG. 3C, the lighting device 314 includes a plurality of discrete light elements, such as LEDs 316A-316D mounted on the tile 312. The LEDs 316A-316D may be configured to emit light of different wavelengths, and may be covered in a clear encapsulant 315, such as a curable epoxy resin, which may provide mechanical and/or environmental protection for the LEDs 316A-316D. More particularly, the LEDs 316A-316D may include a red LED 316A, a blue LED 316B, and a green LED 316C. The blue and/or green LEDs 316B and/or 316C may be indium gallium nitride (InGaN)-based blue and/or green LED chips available from Cree, Inc., the assignee of the present invention. The red LED 316A may be, for example, an aluminum indium gallium phosphorous (AlInGaP) LED chip available from Epistar, Osram, and/or others. In addition, the lighting element 314 may also include an additional green LED 316D in order to make more green light available and/or to provide greater luminance.

Referring again to FIG. 3A, in each solid state lighting device 314 on a particular bar assembly 330, same color LEDs may be serially connected in a string having a single cathode connection at one end of the string and a single anode connection at the other end of the string. Accordingly, each color LED on a bar 330 may be activated by the application of a single voltage, for example, from a lighting controller 305. More particularly, the lighting controller 305 may be configured to activate two different-color LEDs at a same time and/or substantially simultaneously to generate a first image component including a combination of image data for the two different colors. The lighting controller 305 may also be configured to separately activate third color LEDs at a different time than the first and second color LEDs to generate a second image component including image data for the third color. The lighting controller 305 may be configured to alternate between activating the two-different-color LEDs at a same time and separately activating the third color LEDs at a different time to sequentially provide the first and second image components, which may be sequentially displayed to provide a single image, for example, by the LCD display 200 of FIGS. 2A and 2B.

More particularly, referring to FIGS. 3A and 3C, the lighting controller 305 may activate the red LED 316A and the blue LED 316B in each solid state lighting device 314 of the lighting panel 300 at a same time to generate the first image component including a combination of red and blue color image data. The lighting controller 305 may also separately activate the green LEDs 316C and/or 316D at a different time than the red and blue LEDs 316A and 316B in each solid state lighting device 314 to generate the second image component including green color image data. The lighting controller 305 may be configured to alternate between separately activating the greens LED 316C and/or 316D and simultaneously activating the red and blue LEDs 316A and 316B to provide a single image frame. In addition, the lighting controller 305 may be configured to alternately activate the green LEDs 316C and/or 316D and the red and blue LEDs 316A and 316B at a predetermined frequency in order to provide a desired refresh rate. Moreover, in some embodiments, the lighting controller 305 may be configured to activate the red, green, and blue LEDs 316A-316D simultaneously to generate the first image component, and may separately activate the green LEDs 316C and/or 316D at a different time than the red and blue LEDs 316A and 316B to generate the second image component.

Although FIGS. 3A to 3C illustrate exemplary solid state lighting devices and methods of operation according to some embodiments of the present invention, it will be understood that some embodiments of the present invention are not limited to such a configuration, but is intended to encompass any configuration capable of carrying out the operations described herein. For example, while the embodiments illustrated in FIGS. 3A to 3C include four lighting elements 316A-316D per solid state lighting device 314, it will be appreciated that more and/or fewer than four lighting elements 316A-316D may be provided per lighting device 314. For instance, each lighting device 314 may include only three lighting elements, i.e., one of each of the red, blue, and green LEDs 316A-316C. In addition, the lighting controller 305 may be configured to activate the red and green LEDs 316A and 316C at a same time to provide the first image component, and separately activate the blue LED 316B at a different time to provide the second image component. Alternatively, the lighting controller 305 may be configured to activate the blue and green LEDs 316B and 316C at a same time to provide the first image component, and separately activate the red LED 316A at a different time to provide the second image component. Also, although discussed above with reference to red, blue, and green lighting elements, other colored lighting elements may be used. More generally, the lighting controller 305 may be configured to activate any two colored lighting elements at a same time and separately activate a third-color lighting element at a different time than the first- and second-colored lighting elements to generate the first and second image components, which may be sequentially displayed to provide a single image frame.

Figure 4A:
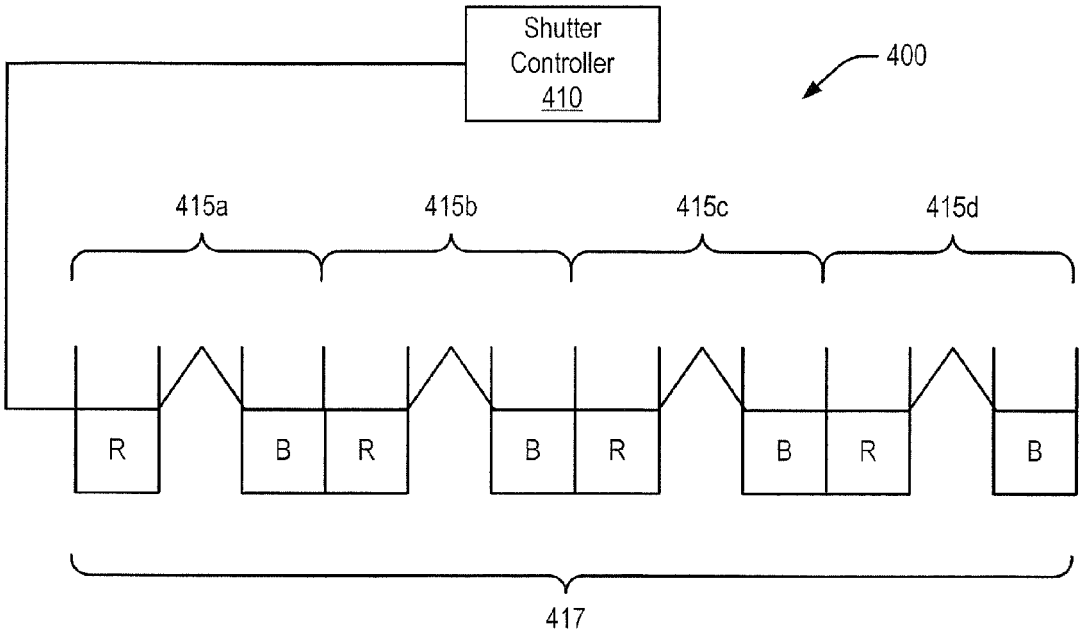
FIGS. 4A to 4E are diagrams illustrating LCD screens and methods of operation according to some embodiments of the present invention.
Figure 4B:
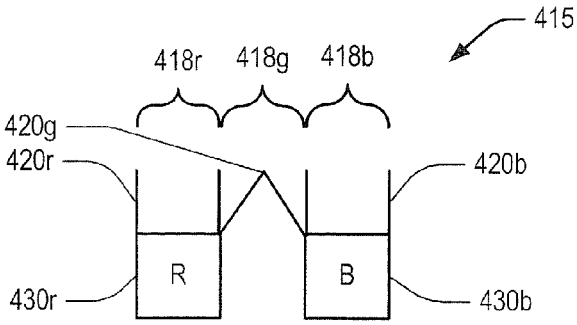

FIGS. 4A to 4E are diagrams illustrating an LCD screen and related methods of operation according to some embodiments of the present invention. Referring now to FIG. 4A, an LCD screen 400 includes a pixel array 417 including a plurality of pixels 415*a*-415*d* configured to display an image. As shown in FIG. 4B, each pixel 415 includes a first subpixel 418*r*, a second subpixel 418*b*, and a third subpixel 418*g*. The first, second, and third subpixels 418*r*, 418*b*, and 418*g* are respectively configured to display first, second, and third color image data. More particularly, the first subpixel 418*r* is configured to display red color image data, the second subpixel 418*b* is configured to display blue color image data, and the third subpixel 418*g* is configured to display green color image data. As such, the first subpixel 418*r* includes a first liquid crystal shutter 420*r* configured to be activated to an open state and a closed state, and a red color filter 430*r* to allow passage of red light and prevent passage of blue light. Similarly, the second subpixel 418*b* includes a second liquid crystal shutter 420*b* configured to be activated to an open state and a closed state, and a blue color filter 430*b* configured to allow passage of blue light and prevent passage of red light. The third subpixel 418*g* also includes a third liquid crystal shutter 420*g* configured to be activated to an open state and a closed state. However, the third subpixel 418*g* does not include a color filter.

Accordingly, referring again to FIG. 4A, a shutter controller 410 is configured to selectively activate the first and second liquid crystal shutters 420*r* and 420*b* to the open state and activate the third liquid crystal shutter 420*g* to the closed state to generate a first image component, which includes a combination of red and blue image color data. The shutter controller 410 is also configured to activate the third shutter 420*g* to the open state to generate a second image component, which includes green color image data. More specifically, the shutter controller 410 is configured to activate the third liquid crystal shutter 420*g* to the open state to allow passage of green light to generate the second image component, and may be configured to activate the first and/or second liquid crystal shutters 420*r* and 420*b* to the closed state to prevent passage of red and/or blue light. As such, the shutter controller 410 is configured to selectively activate the third liquid crystal shutter 420*g* to perform a filtering function, i.e., to allow passage of green light and prevent passage of red and blue light so that the third subpixel 418*g* may display green color image data without the use of a color filter.

Figures 4C, 4D, 4E:
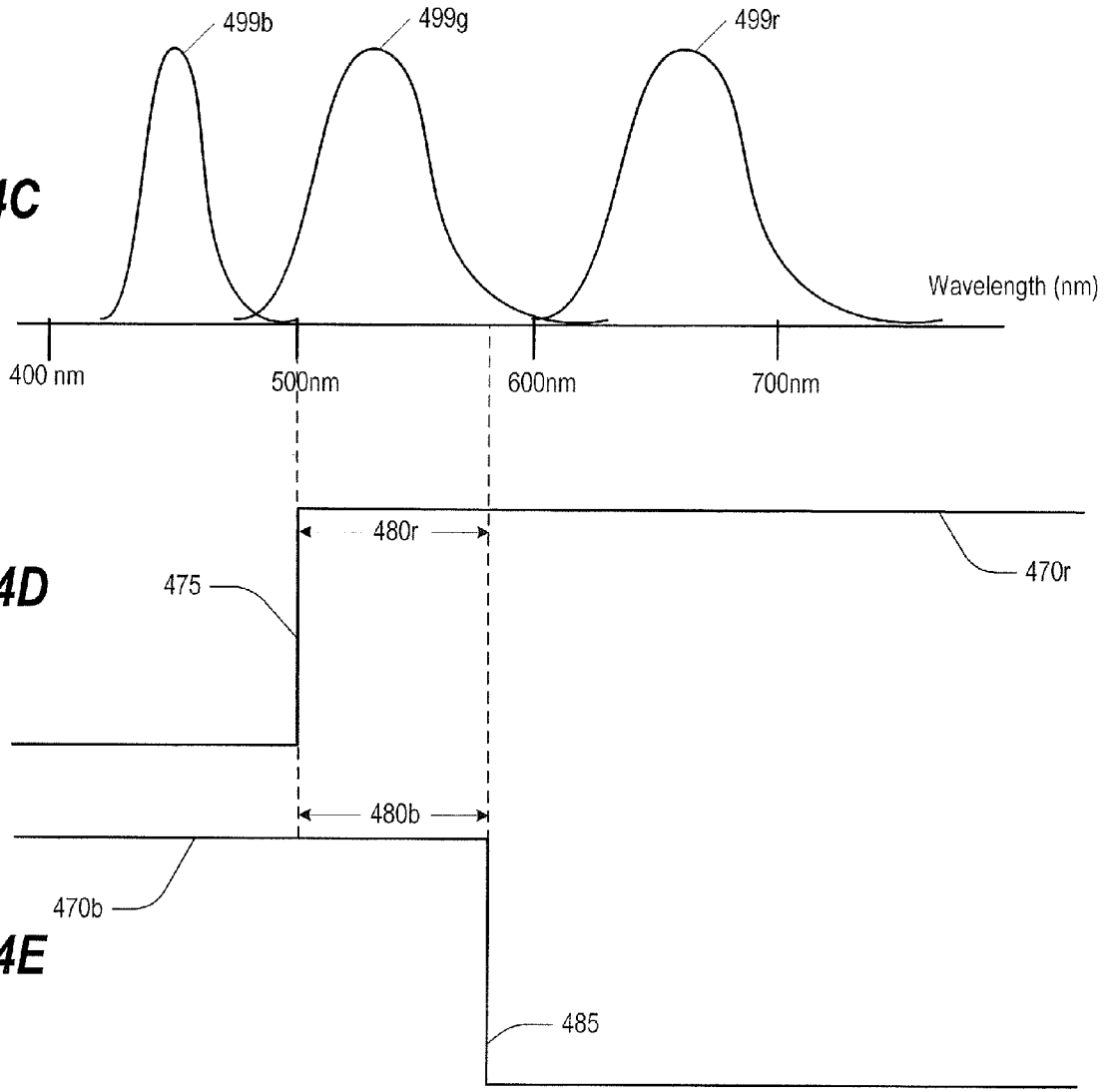

In addition, depending on the filtering characteristics of the red color filter 430*r* and/or the blue color filter 430*b*, the shutter controller 410 may be configured to selectively activate the first and/or second liquid crystal shutters 420*r* and/or 420*b* to the open and/or closed states to generate the second image component. For example, in some embodiments, the color filters 430*r* and/or 430*b* may both be configured to allow passage of green light, and the shutter controller 410 may activate the shutters 420*r* and 420*b* to the closed state to generate the second image component. More particularly, FIG. 4C illustrates wavelengths corresponding to blue light 499*b*, green light 499*g*, and red light 499*r*, while FIGS. 4D and 4E illustrate transfer functions for the red and blue color filters 430*r* and 430*b*, respectively, according to some embodiments of the present invention. As shown in FIG. 4D, the red color filter 430*r* may be configured to allow passage of red light 499*r* but prevent passage of blue light 499*b*, as illustrated by transfer function 470*r*. The cutoff wavelength 475 of the red color filter 430*r* may be provided above the maximum wavelength of the blue light 499*b* to blocked, but well below the minimum wavelength of the red light 499*r* to be transmitted. As such, losses of portions of the red light 499*r* near the cutoff wavelength 475 of the red color filter 430*r* may be reduced and/or minimized. Similarly, as shown in FIG. 4E, the blue color filter 430*b* may be configured to allow passage of blue light 499*b* but prevent passage of red light 499*r*, as illustrated by transfer function 470*b*. The cutoff wavelength 485 of the blue color filter 430*b* may be provided below the minimum wavelength of the red light 499*r* to sufficiently block transmission thereof, but well beyond the maximum wavelength of the blue light 499*b* to be transmitted. Thus, losses of portions of the blue light 499*b* near the cutoff wavelength 485 of the blue color filter 430*b* may also be reduced and/or minimized. In addition, the transfer functions 470*r* and 470*b* may include overlapping portions 480*r* and 480*b* between the cutoff wavelengths 475 and 485, such that the color filters 430*r* and 430*b* may allow passage of at least a portion of the green light 499*g*. In other words, the red color filter 430*r* may be broadened to allow passage of all light having a wavelength greater than a maximum wavelength of the blue light 499*b*, and the blue color filter 430*b* may be broadened to allow passage of all light having a wavelength less then a minimum wavelength of the red light 499*r*, thereby increasing brightness and/or efficiency.

Accordingly, the shutter controller 410 may be configured to activate the shutters 420*r* and 420*b* to the closed state to generate the second image component when the color filters 430*r* and/or 430*b* are configured to allow passage of green light, such that the red color filter 430*r* may be configured to block only blue light, while the blue color filter 430*b* may be configured to block only red light. As such, losses of portions of the red light 499*r* and/or blue light 499*b* spectrum due to the presence of the color filters 430*r* and 430*b*, respectively, may be reduced. In other words, the shutter controller 410 may activate the third liquid crystal shutter 420*g* to the closed state when the first and second liquid crystal shutters 420*r* and 420*b* are in the open state to generate the first image component, and may activate the third liquid crystal shutter 420*g* to the open state when the first and second liquid crystal shutters 420*r* and 420*b* are in the closed state to generate the second image component.

However, referring again to FIG. 4B, if the color filters 430*r* and 430*b* are configured to prevent passage of green light, the shutter controller 410 may activate the first and/or second liquid crystal shutters 420*r* and/or 420*b* to the open state or to the closed state to generate the second image component. For example, if an electric charge must be applied to activate the liquid crystal shutters to the closed state, the shutter controller 410 may be configured to activate the first and second liquid crystal shutters 420*r* and 420*b* to the open state to generate the second image component, for example, to reduce power consumption. In addition, the shutter controller 410 may be configured to activate the liquid crystal shutters 420*r* and 420*b* to maintain the same positions (i.e., open or closed) used to generate the first image component during generation of the second image component, for example, in the event that at least some of the first and/or second liquid crystal shutters 420*r* and/or 420*b* may be activated to the same position to generate the first image component of the next image frame. More generally, the shutter controller 410 may be configured to activate the first and/or second liquid crystal shutters 420*r* and/or 420*b* to the open and/or closed states to improve efficiency in generating the second image component based on the filtering characteristics of the color filters 430*r* and 430*b*.

In addition, the shutter controller 410 may be configured to accelerate a shutter rate of the first, second, and third shutters 420*r*, 420*b*, and 420*g* to provide a predetermined refresh rate for the displayed image. More particularly, as the LCD screen 400 is configured to sequentially display two image components in sequence in order to provide a single image, the shutter controller 410 may increase the shutter rate of the liquid crystal shutters 420*r*, 420*b*, and 420*g* by a factor of two in order to maintain a refresh rate comparable to that of a conventional LCD device.

Although FIGS. 4A to 4E illustrate an exemplary LCD screen and related elements according to some embodiments of the present invention, it will be understood that some embodiments of the present invention are not limited to such a configuration, but is intended to encompass any configuration capable of carrying out the operations described herein. For example, although the LCD screen 400 is illustrated as being configured to display red, green, and blue color image data using only red and blue color filters, it is to be understood that the LCD screen 400 may be configured to display the red, green, and blue color image data using any two color filters without using a filter of the third color. For example, in some embodiments, the second and third subpixels 418*b* and 418*g* of the LCD screen 400 may include blue and green color filters, respectively, and the first subpixel 418*r* may not include a color filter. Alternatively, the first and third subpixels 418*r* and 418*g* may include red and green color filters, respectively, and the second subpixel 418*b* may not include a color filter. In addition, although discussed above with reference to red, blue, and green filters, other color filters may be used as well. For example, the LCD screen 400 may be configured to display magenta, yellow, and cyan light using only magenta and cyan color filters. More generally, according to some embodiments of the present invention, the LCD screen 400 may be configured to display N colors of light using N−1 color filters. As such, the shutter controller 410 may be configured to activate the liquid crystal shutter associated with a filterless subpixel to the closed state and selectively activate the liquid crystal shutters associated with the other subpixels of each pixel to the open state to generate the first image component, and may be configured to selectively activate the liquid crystal shutter associated with the filterless subpixel to the open state to generate the second image component.

Figure 5:
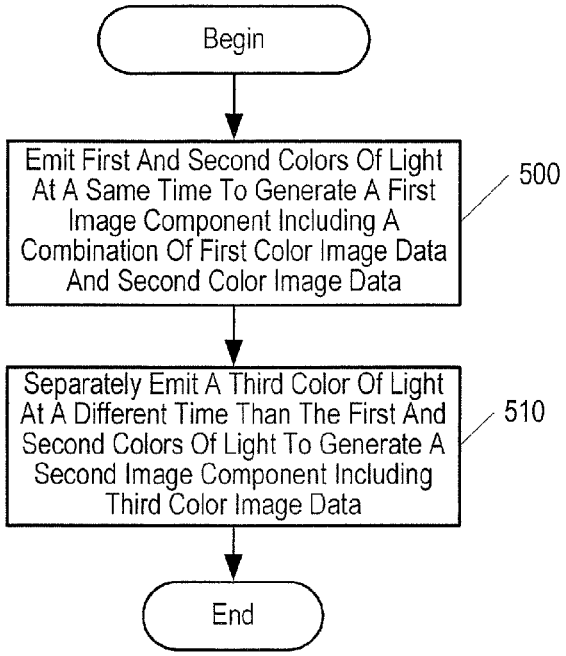
FIG. 5 is a flowchart illustrating operations that may be performed by a solid state lighting panel according to some embodiments of the present invention.

FIG. 5 is a flowchart illustrating exemplary operations that may be performed by a solid state lighting device according to some embodiments of the present invention. For example, the solid state lighting device may be a backlight, such as the backlight 202 of FIGS. 2A and 2B, for use in an LCD device, such as the LCD device 200. Referring now to FIG. 5, operations begin at Block 500 when first and second colors of light are emitted at a same time to generate a first image component including a combination of first color image data and second color image data. More particularly, red and blue light may be emitted during at least partially overlapping time periods to generate a first image component including a combination of red color image data and blue color image data. For instance, the red and blue light may be simultaneously emitted to generate the first image component. At Block 510, a third color of light is separately emitted at a different time than the first and second colors of light to generate a second image component including third color image data. For example, green light may be emitted separately from the red light and blue light to generate a second image component including green color image data. More generally, any two colors of light may be emitted at a same time to generate a first image component at Block 500, and a remaining third color of light may be emitted separately (i.e., at a different time) from the other two colors of light to generate the second image component at Block 510. As such, red and green light may be simultaneously emitted at Block 500, and blue light may be separately emitted at Block 510. Likewise, blue and green light may be simultaneously emitted at Block 500, and red light may be separately emitted at a different time at Block 510. The selection of the colors of light to be simultaneously and/or separately emitted may depend, for example, on the filter configuration of an LCD screen that is to be used with the solid state lighting device. For example, in some embodiments, red, blue, and green light may be simultaneously emitted at Block 500, and the green light may be filtered by one or more color filters to generate the first image component including the red and blue color image data. Accordingly, the first image component (including a combination of color image data for two colors) and second image component (including color image data for the third color) may be sequentially displayed in order to provide a single image frame.

In addition, in some embodiments, the first and second image components may be sequentially generated at Blocks 500 and 510 at a predetermined frequency to provide a desired refresh rate and/or frame rate for the displayed image. For example, the operations of Blocks 500 and 510 may be alternated to sequentially generate the second and first image components in accordance with a shutter rate (or pixel response time) of a plurality of liquid crystal shutters configured to display the first and second image components. More particularly, the first and second image components may be generated at Blocks 500 and 510 based on an accelerated shutter rate, such that an image may be displayed at a refresh rate comparable to that of a conventional LCD device.

Figure 6:
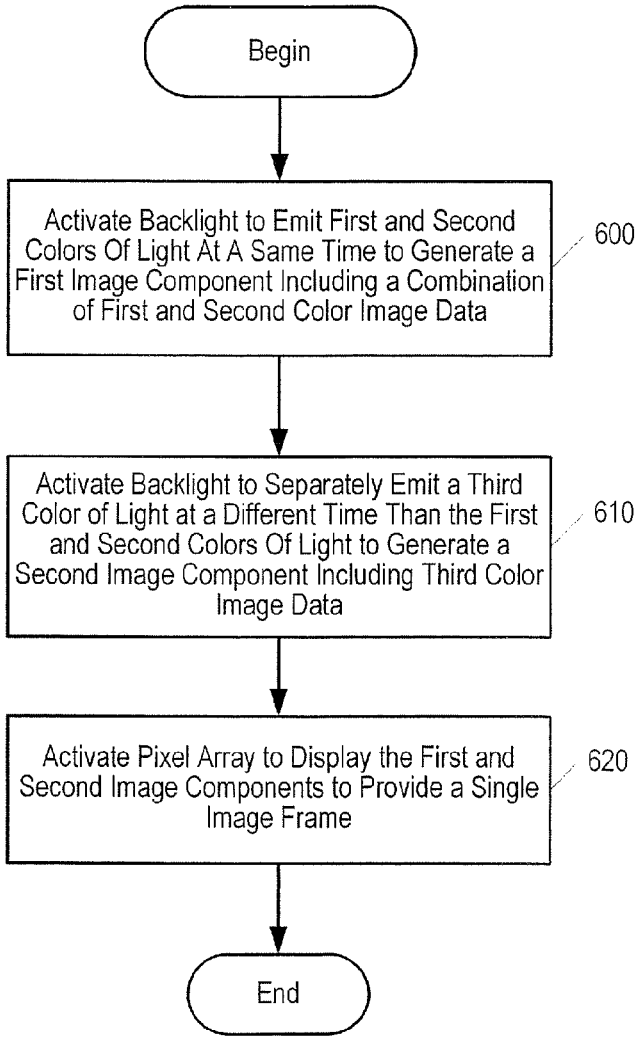
FIG. 6 is a flowchart illustrating operations that may be performed by an LCD device according to some embodiments of the present invention.

FIG. 6 is a flowchart illustrating exemplary operations that may be performed by a liquid crystal display device including a backlight and a pixel array according to some embodiments of the present invention, such as the LCD device 200 of FIGS. 2A and 2B. Referring now to FIG. 6, operations begin at Block 600 when the backlight is activated to emit first and second colors of light at a same time to generate a first image component. The first image component includes a combination of first and second color image data. For example, the backlight may be activated to simultaneously emit red and blue light, and as such, the first image component may include a combination of both red and blue color image data. However, it is to be understood that two colors of light emitted at the same time may be emitted for different (but at least partially overlapping) durations of time.

At Block 610, the backlight is activated to separately emit a third color of light at a different time than the first and second colors of light to generate a second image component. The second image component includes third color image data. For example, the backlight may be activated to emit green light separately from the red and blue light, and as such, the second image component may include green color image data. However, as discussed above, the backlight may be activated to emit any two colors of light at a same time to generate a first image component at Block 600, and may be activated to emit a remaining third color of light separately from the other two colors of light to generate the second image component at Block 610.

Still referring to FIG. 6, the pixel array is activated to display the first image component and the second image component to provide a single image frame at Block 620. For example, the pixel array may be activated to rapidly display, in sequence, an image component including green color image data followed by an image component including a combination of red and blue color image data, such that a user and/or viewer of the LCD device may perceive a single full-color image. As such, the pixel array may be activated in coordination with the backlight to display any two-image component sequence at Block 620, where one image component includes only one of red, green, or blue color image data, and where the other image component includes a combination of color image data for the remaining two colors. More particularly, the liquid crystal shutters of each subpixel of the pixel array may be selectively activated in synchronization with the output of the backlight, as will be discussed in greater detail below.

Figure 7:
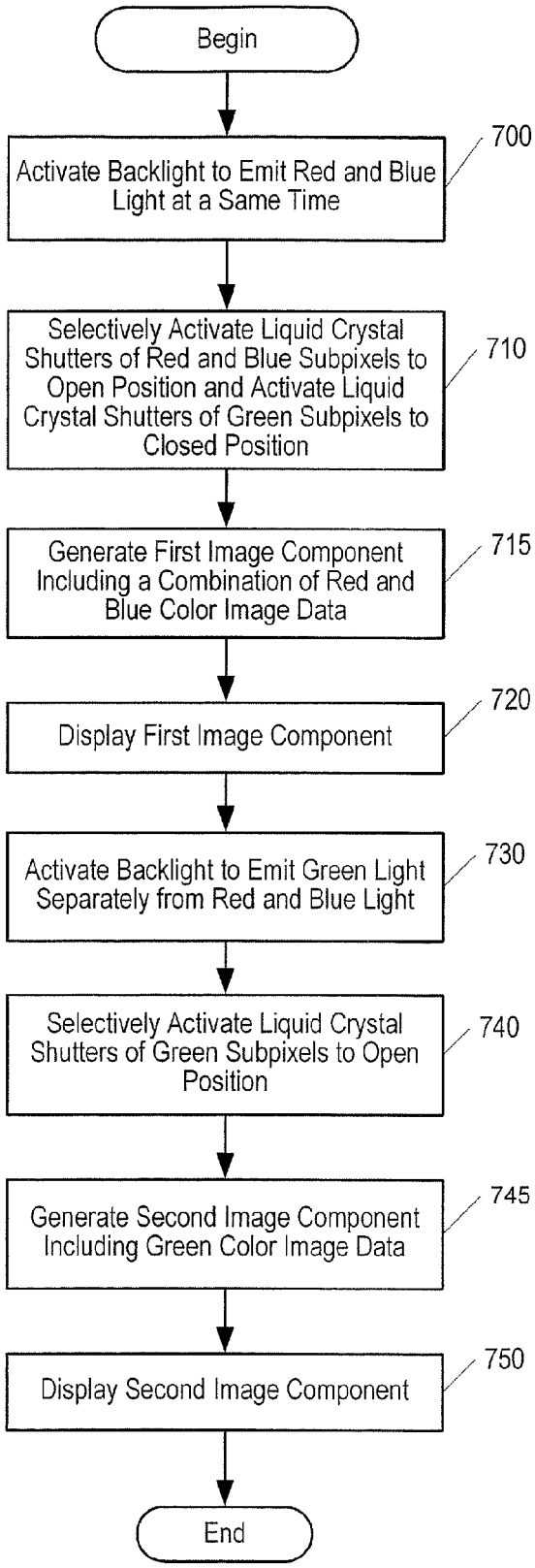
FIG. 7 is a flowchart illustrating further operations that may be performed by an LCD device according to some embodiments of the present invention.

FIG. 7 is a flowchart illustrating more detailed operations that may be performed by a liquid crystal display device including a backlight and a pixel array according to some embodiments of the present invention. Referring now to FIG. 7, operations begin at Block 700 when the backlight is activated to emit red and blue light at a same time. For example, the backlight may include red, blue, and green solid state lighting elements, such as LEDs, and the red and blue lighting elements may be activated substantially simultaneously to emit the red and blue light during at least partially overlapping time periods. Concurrently, at Block 710, the liquid crystal shutters associated with the red and blue subpixels of each pixel of the pixel array are selectively activated to an open state, and the liquid crystal shutters associated with the green subpixel of each pixel of the pixel array are activated to a closed state. As such, red color filters associated with the red subpixels may allow passage of the red light and prevent passage of the blue light, while blue color filters associated with the blue subpixels may allow passage of the blue light and prevent passage of the red light. In addition, as the liquid crystal shutters associated with the green subpixels are activated to the closed state, the green subpixels may be configured to prevent the passage of red and blue light therethrough without the use of a color filter. In other words, the liquid crystal shutters associated with the green subpixels may be selectively activated to perform a filtering function. Accordingly, red color image data displayed by the red subpixels and blue color image data displayed by the blue subpixels may be combined to generate a first image component at Block 715. The first image component including the combination of the red and blue color image data is displayed by the pixel array at Block 720.

Still referring to FIG. 7, the backlight is activated to separately emit green light at a different time than red and blue light at Block 730. For example, where the backlight includes red, blue, and green solid state lighting elements, the green solid state lighting element may be activated at a different time than the red and blue solid state lighting elements to emit the green light separately from the red and blue light. Concurrently, at Block 740, the liquid crystal shutters associated with the green subpixels are selectively activated to the open state to allow passage of the green light. The liquid crystal shutters associated with the red and blue subpixels may also be activated to the closed state when the backlight is activated to emit green light to prevent passage of the green light therethrough. However, in some embodiments, the red and blue color filters associated with the red and blue subpixels may be configured to prevent passage of green light, and as such, the liquid crystal shutters associated with the red and/or blue subpixels may be activated to the open state when the backlight is activated to emit green light. Thus, a second image component including green color image data is generated at Block 745. The second image component including the green color image data is displayed by the pixel array at Block 750.

Accordingly, as illustrated in FIG. 7, first and second subpixels of each pixel in the pixel array may be selectively activated when the backlight is activated to emit first and second colors of light at a same time to generate a first image component, and a third subpixel of each pixel of the pixel array may be selectively activated when the backlight is activated to separately emit a third color of light at a different time than the first and second colors to generate a second image component. The first and second image components may be sequentially displayed to provide a single image frame.

The operations of FIG. 7 may be performed to activate the pixel array and the backlight to sequentially display the first image component and the second image component in rapid succession, such that a single full-color image frame may be perceived by a viewer. As such, the rate at which the pixel array may sequentially display the first and second image components may be dependent on the switching speed of the liquid crystal shutters and/or the lighting elements of the backlight. For instance, to sequentially display the first and second image components at an image refresh rate comparable to that of a conventional liquid crystal display, a shutter rate of the liquid crystal shutters may be accelerated. More specifically, to provide each two-image sequence, the shutter rate of the liquid crystal shutters may be doubled. As the switching rate of the lighting elements of the backlight may be significantly faster than the shutter rate of the liquid crystal shutters, the backlight may be activated based on the shutter rate of the liquid crystal shutters. More particularly, the backlight may be activated to emit the red and blue light at Block 700 when the liquid crystal shutters associated with the green subpixels are activated to the closed state at Block 710, and may be activated to separately emit the green light at a different time than the red and blue light at Block 730 when the liquid crystal shutters associated with the green subpixels are activated to the open state at Block 740. As such, in some embodiments, the refresh rate of the LCD device may be dependent on a maximum shutter rate of the liquid crystal shutters.

The flowcharts of FIGS. 5 through 7 illustrate exemplary operations of some solid state lighting devices and/or liquid crystal display devices according to embodiments of the present invention. In this regard, each block may represent a module, segment, or portion of code, which may comprise one or more executable instructions for implementing the specified logical functions. It should also be noted that in other implementations, the functions noted in the blocks may occur out of the order noted in the figures. For example, two blocks shown in succession may, in fact, be executed substantially concurrently, or the blocks may sometimes be executed in the reverse order, depending on the functionality involved. More particularly, although the flowcharts of FIGS. 5 through 7 illustrate generating and/or displaying the first image component prior to the second image component, it is to be understood that the blocks may be executed such that the second image component is generated and/or displayed prior to the first image component.

Further embodiments of the present invention provide devices and methods for sequentially displaying first and second image components to provide a single full-color image using an LCD device including two subpixels configured to display three colors of light. For example, each pixel in an LCD device according to some embodiments of the present invention may include a red/green subpixel and a blue/green subpixel. The red/green subpixel may include a liquid crystal shutter and a color filter configured to allow passage of both red and green light but prevent passage of blue light, and the blue/green subpixel may include a liquid crystal shutter and a color filter configured to allow passage of both blue and green light but prevent passage of red light. As such, three colors of light may be displayed using two color filters by coordinating the activation of the corresponding liquid crystal shutters of the display with the activation of the desired color in the backlight.

Figure 8A:
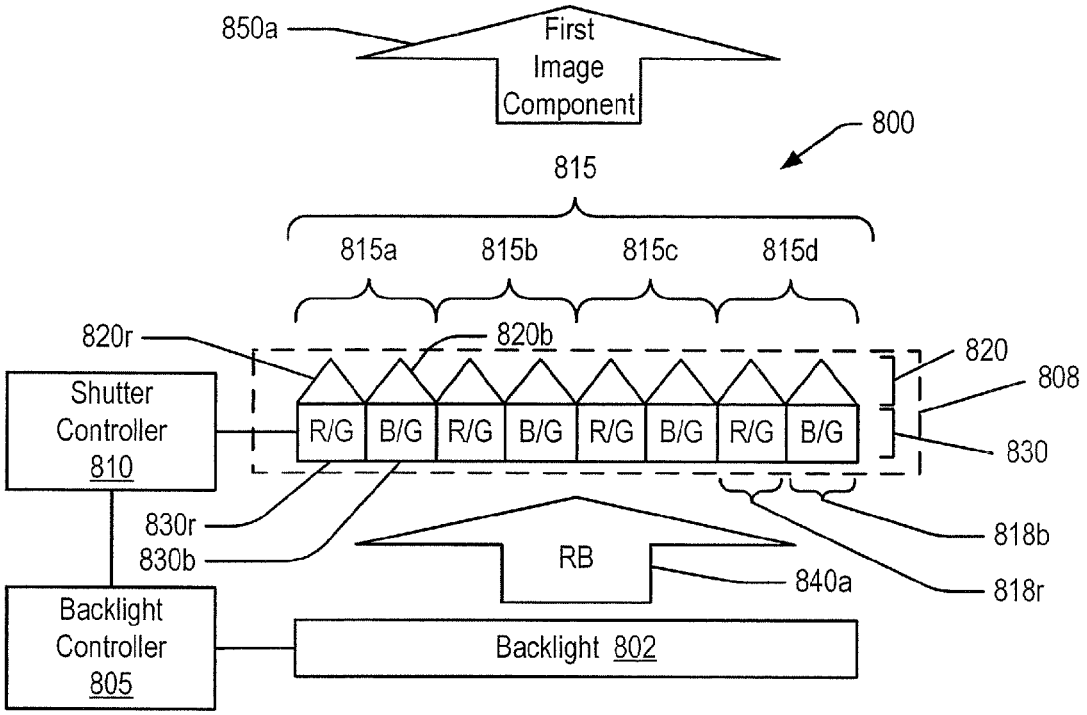
FIGS. 8A and 8B are block diagrams illustrating LCD devices and methods of operation according to further embodiments of the present invention.
Figure 8B:
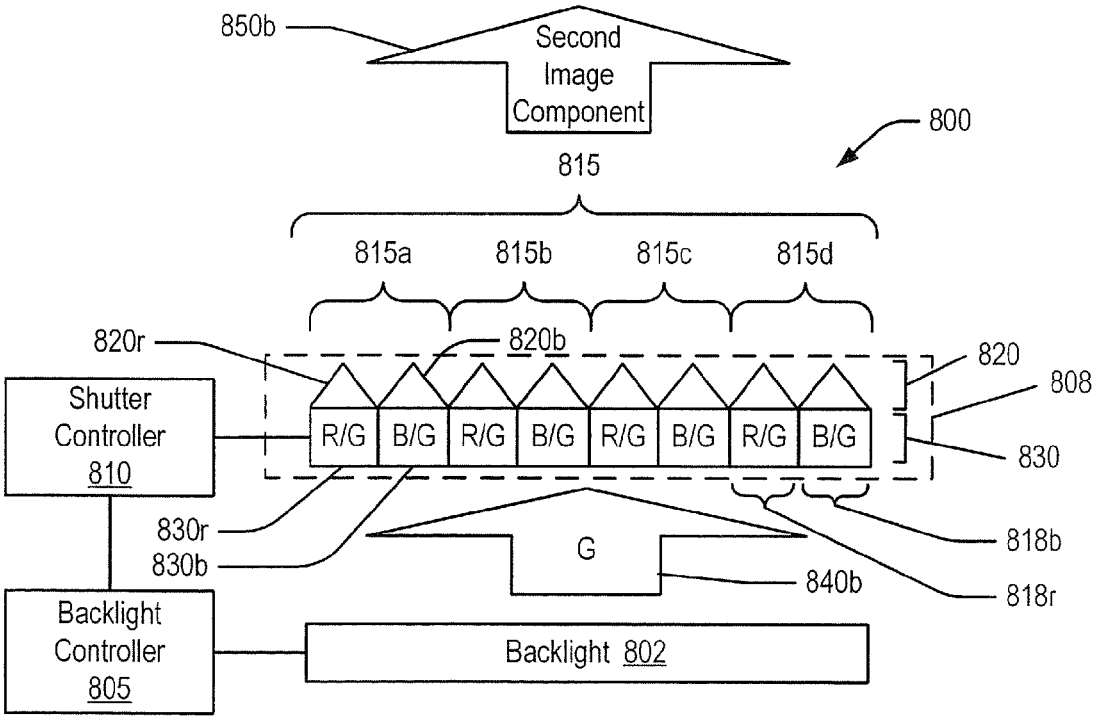

FIGS. 8A and 8B illustrate an LCD device 800 and methods of operation according to further embodiments of the present invention. Referring now to FIGS. 8A and 8B, the LCD device 800 includes a backlight 802 and an LCD screen 808. The backlight 802 is configured to emit first, second, and/or third colors of light. More particularly, the backlight 802 is configured to emit red, green, and blue light. For example, the backlight 802 may include red, green, and blue solid-state lighting elements (such as the LEDs 316A-316D of FIG. 3C) configured to emit the red, green, and blue light. The LCD screen 808 includes a pixel array 815 including a plurality of pixels 815*a*-815*d*. Each of the pixels 815*a*-815*d* includes first and second subpixels 818*r* and 818*b*. Each of the subpixels 818*r* and 818*b* includes a color filter 830 and a liquid crystal shutter 820 configured to be activated to an open state and a closed state to display a particular color of light. In addition, at least one of the first and second subpixels 818*r* and 818*b* is a two-color subpixel, i.e., a subpixel including a color filter that is configured to display two colors of light. For example, the subpixel 818*r* may include a color filter 830*r* configured to allow passage of at least a first color of light but prevent passage of a second color of light, while the subpixel 818*b* may include a color filter 830*b* configured to allow passage of the second color of light and a third color of light but prevent passage of the first color of light.

In particular, as shown in FIGS. 8A and 8B, the first subpixel 818*r* is a red/green (R/G) subpixel configured to display red and green color image data, and the second subpixel 818*b* is a blue/green (B/G) subpixel configured to display blue and green color image data. More particularly, the subpixel 818*r* includes a red/green color filter 830*r* configured to allow passage of red and green light but prevent passage of blue light, and a liquid crystal shutter 820*r* configured to be activated to an open state and a closed state to display the red and green color image data. Similarly, the subpixel 818*b* includes a blue/green color filter 830*b* configured to allow passage of blue and green light but prevent passage of red light, and a liquid crystal shutter 820*b* configured to be activated to an open state and a closed state to display the blue and green color image data.

Accordingly, the shutters 820 and the backlight 802 may be selectively activated to display the red, blue, and green color image data to provide a full-color image. More particularly, as shown in FIGS. 8A and 8B, the LCD device 800 includes a backlight controller 805 coupled to the backlight 802 and a shutter controller 810 coupled to the LCD screen 808. The backlight controller 805 is configured to activate the backlight 802 to emit two colors of light at a same time to generate a first image component, and to separately emit a third color of light at a different time from the first and second colors of light to generate a second image component. However, it is to be understood that there may be some negligible overlap between the time of emission of the third color of light and the time of emission of the first and second colors of light in some embodiments. As such, the first image component includes a combination of color image data for the two colors of light, and the second image component includes color image data for the third color of light. In addition, the shutter controller 810 is configured to selectively activate the liquid crystal shutters 820*r* and 820*b* of each pixel based on the output of the backlight 802 to generate the first and second image components. The first and second image components may be sequentially displayed by the LCD device 800 to provide a single full-color image frame.

For example, as shown in FIG. 8A, the backlight controller 805 activates the backlight 802 to simultaneously emit both red and blue light 840*a*. For example, the backlight 802 may include a plurality of red, blue, and green light emitting diodes (LEDs), and the backlight controller 805 may be configured to activate the red and blue LEDs substantially simultaneously to emit the red and blue light 840*a*. Also, the shutter controller 810 selectively activates the liquid crystal shutters 820*r* and 820*b* when the backlight 802 is activated to simultaneously emit the red and blue light 840*a* to display both red and blue color image data in the pixels 815*a*-815*d*. More particularly, the liquid crystal shutter 820*r* and the color filter 830*r* allow the passage of red light (and prevent the passage of blue light) through the subpixel 218*r*, while the liquid crystal shutter 820*b* and the color filter 830*b* allow the passage of blue light (and prevent the passage of red light) through the subpixel 818*b*. As such, the red color image data and the blue color image data are combined to provide the first image component 850*a*.

In addition, as shown in FIG. 8B, the backlight controller 805 activates the backlight 802 to separately emit green light 840*b* at a different time than the red and blue light 840*a* of FIG. 8A, and the shutter controller 810 selectively activates the liquid crystal shutters 820*r* and 820*b* when the backlight 802 is activated to emit the green light 840*b* to display green color image data. More particularly, the liquid crystal shutters 820*r* and 820*b* and the color filters 830*r* and 830*b* allow the passage of the green light 840*b* through one or both of the subpixels 818*r* and 818*b*. Thus, the green color image data can be displayed in each of the subpixels 818*r* and 818*b* of the pixels 815*a*-815*d* to provide the second image component 850*b*. Accordingly, the backlight controller 805 and the shutter controller 810 may be configured to rapidly alternate between the shutter/backlight configuration illustrated in FIG. 8A and the shutter/backlight configuration illustrated in FIG. 8B to sequentially display the first and second image components 850*a* and 850*b* to provide a single full-color image.

Also, the shutter controller 810 may be configured to accelerate a shutter rate of the liquid crystal shutters 820 to provide a predetermined image refresh rate. For example, in order to sequentially display the first image component 850*a* and the second image component 850*b* to provide each image frame, the shutter controller 810 may activate the liquid crystal shutters 820 at double the rate to provide a similar image refresh rate as that of a conventional liquid crystal display, such as the liquid crystal display 100 of FIG. 1. As such, the backlight controller 805 may also be configured to activate the backlight 802 based on the increased shutter rate of the shutters 820. More specifically, as the switching rate of the shutters 820 may be a limiting factor as compared to the switching rate of the backlight 802, the backlight controller 805 may be configured to alternate between activating the backlight 802 to emit the red and blue light 840*a* at a same time and activating the backlight 802 to separately emit the green light 840*b* at a different time based on the switching rate of the shutters 820 to generate the first and second image components 850*a* and 850*b* of each image frame. However, in some embodiments, the shutter controller 810 may not accelerate the switching rates of the liquid crystal shutters 820, and the liquid crystal display 800 may sequentially display the first and second image components 850*a* and 850*b* to provide each image frame at half of the refresh rate of a conventional liquid crystal display, which may also be visibly acceptable.

Although FIGS. 8A and 8B illustrate exemplary liquid crystal display devices and methods of operation according to some embodiments of the present invention, it will be understood that some embodiments of the present invention are not limited to such a configuration, but is intended to encompass any configuration capable of carrying out the operations described herein. For example, although the liquid crystal display device 800 is illustrated as being configured to sequentially display the first image component 850*a* before the second image component 850*b*, it is to be understood that the liquid crystal display device 800 may display the second image component 850*b* prior to the first image component 850*a* to provide each image frame in some embodiments. In addition, although illustrated as simultaneously emitting red and blue light 840*a* and separately emitting green light 840*b*, it is to be understood that the backlight 802 may be configured to emit any two colors of light at a same time, and may separately emit a remaining third color of light at a different time than the first and second colors of light, or vice versa. It is also to be understood that two colors of light emitted at the same time may be emitted for different (but at least partially overlapping) durations of time.

Furthermore, although the LCD screen 808 is illustrated as including red/green and blue/green subpixels, it is to be understood that the LCD screen 808 may include any combination of two subpixels that are configured to display three colors of light. For example, the subpixel 818*r* may include a filter 820*r* configured to allow passage of red light but prevent passage of blue and green light, while the subpixel 818*b* may include a filter 820*b* configured to allow passage of blue and green light but prevent passage of red light. Likewise, the subpixel 818*r* may include a filter 820*r* configured to allow passage of red and green light but prevent passage of blue light, while the subpixel 818*b* may include a filter 820*b* configured to allow passage of blue light but prevent passage of red and green light. Moreover, the subpixel 818*r* may include a filter 820*r* configured to allow passage of green light but prevent passage of red and blue light, while the subpixel 818*b* may include a filter 820*b* configured to allow passage of red and blue light but prevent passage of green light. As such, the backlight controller 805 may be configured to activate the backlight 802 to separately emit a color of light corresponding to one of the colors that is permitted to pass through a two-color subpixel in the LCD screen 808, and to simultaneously emit the remaining two colors of light. More generally, the backlight 802 and the LCD screen 808 may be configured to provide any two-image component sequence to display a single full-color image frame, where one image component includes only one of red, green, or blue color image data, and where the other image component includes a combination of color image data for the remaining two colors, depending on the characteristics of the particular color filters used in the screen 808.

Figure 9A:
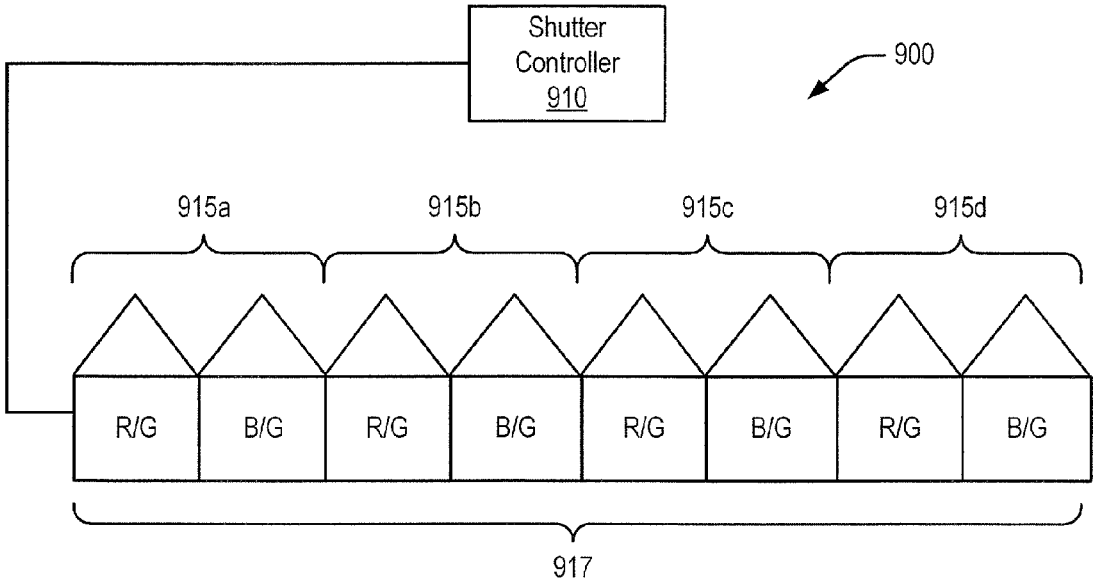
FIGS. 9A to 9E are diagrams illustrating LCD screens and methods of operation according to further embodiments of the present invention.
Figure 9B:
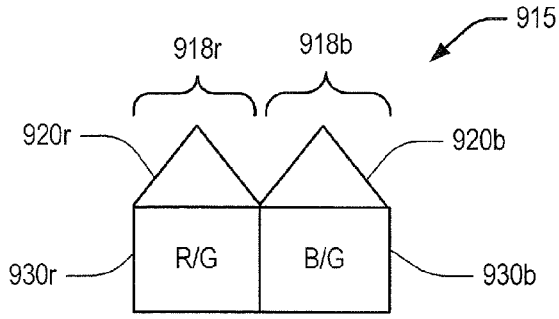

FIGS. 9A to 9E illustrate an LCD screen and related characteristics and methods of operation according to some embodiments of the present invention. Referring now to FIG. 9A, an LCD screen 900 includes a pixel array 917 including a plurality of pixels 915*a*-915*d* configured to display an image. As shown in FIG. 9B, each pixel 915 includes a first subpixel 918*r* and a second subpixel 918*b*, at least one of which is a two-color subpixel configured to display image data of two colors. For example, the first subpixel 918*r* may be configured to display first and second color image data, while the second subpixel 918*b* may be configured to display second and third color image data. More particularly, the first subpixel 918*r* is configured to display red and green color image data, while the second subpixel 918*b* is configured to display blue and green color image data. As such, the first subpixel 918*r* includes a first liquid crystal shutter 920*r* configured to be activated to an open state and a closed state, and a red/green (R/G) color filter 930*r* configured to allow passage of red and green light but prevent passage of blue light. Similarly, the second subpixel 918*b* includes a second liquid crystal shutter 920*b* configured to be activated to an open state and a closed state, and a blue/green (B/G) color filter 430*b* configured to allow passage of blue and green light but prevent passage of red light.

Accordingly, referring again to FIG. 9A, a shutter controller 910 is configured to selectively activate the first and second liquid crystal shutters 920*r* and 920*b* in coordination with a backlight to allow passage of red and blue light to generate a first image component including a combination of red and blue image color data. The shutter controller 910 is also configured to selectively activate the first and second liquid crystal shutters 920*r* and 920*b* in coordination with the backlight to allow passage of green light to generate a second image component including green color image data. As such, the two subpixels 918*r* and 918*b* may be selectively activated by the shutter controller 910 to display three colors of light.

Figure 9C:
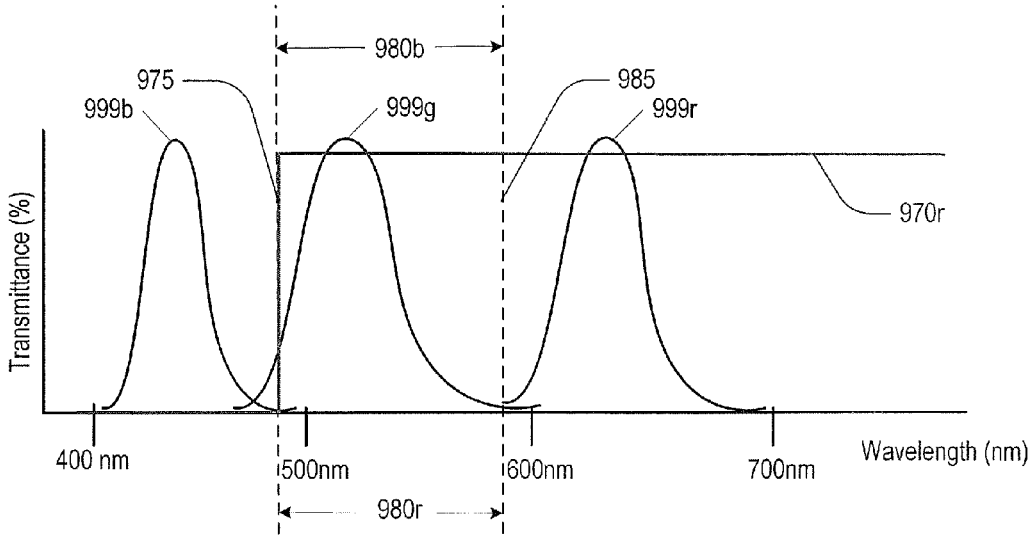
Figure 9D:
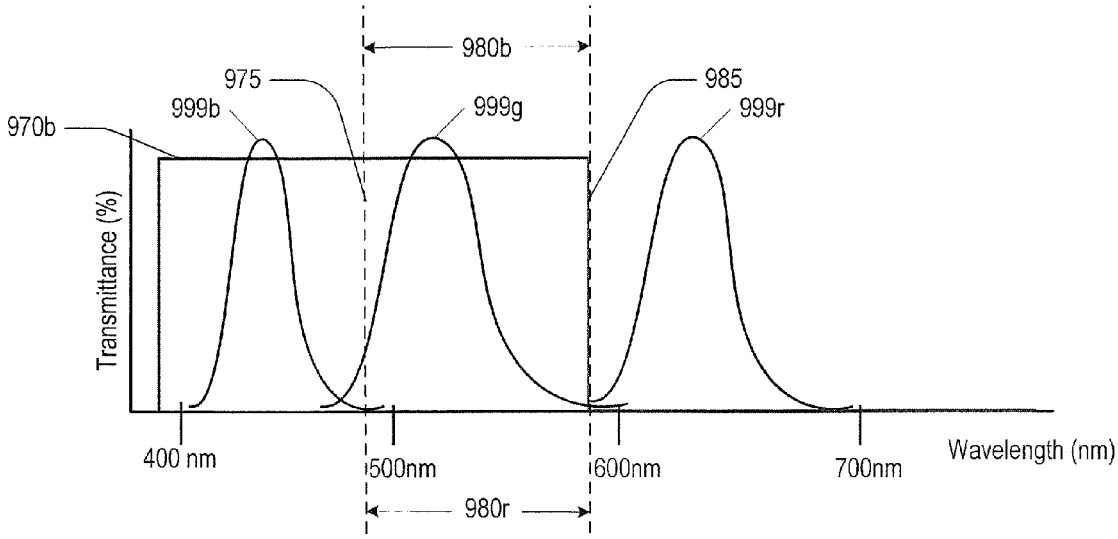

FIGS. 9C and 9D illustrates the transfer functions for the color filters 930*r* and 930*b* that may be used in two-color subpixels according to some embodiments of the present invention relative to wavelengths corresponding to blue light 999*b*, green light 999*g*, and red light 999*r*. As shown in FIG. 9C, the red/green color filter 930*r* may be configured to allow passage of red light 999*r* and green light 999*g* but prevent passage of blue light 999*b*, as illustrated by transfer function 970*r*. The cutoff wavelength 975 of the red/green color filter 930*r* may be provided above the maximum wavelength of the blue light 999*b* to blocked, but below the minimum wavelengths of the red light 999*r* and the green light 999*g* to be transmitted. Similarly, as shown in FIG. 9D, the blue/green color filter 930*b* may be configured to allow passage of blue light 999*b* and green light 999*g* but prevent passage of red light 999*r*, as illustrated by transfer function 970*b*. The cutoff wavelength 985 of the blue/green color filter 930*b* may be provided below the minimum wavelength of the red light 999*r* to sufficiently block transmission thereof, but beyond the maximum wavelength of the blue light 999*b* and the green light 999*g* to be transmitted. In other words, the red/green color filter 930*r* may allow passage of all light having a wavelength greater than a maximum wavelength of the blue light 999*b*, and the blue/green color filter 930*b* may allow passage of all light having a wavelength less then a minimum wavelength of the red light 499*r*. As such, the transfer functions 970*r* and 970*b* may include overlapping portions 980*r* and 980*b* between the cutoff wavelengths 975 and 985, as both of the color filters 930*r* and 930*b* may allow passage of the green light 999*g*.

It is to be understood that the transfer functions 970*r* and 970*b* illustrated in FIGS. 9C-9D represent idealized embodiments of the invention. As such, variations from the shapes of the illustrated transfer functions are to be expected. Thus, embodiments of the invention should not be construed as limited to the particular shapes of regions illustrated herein but are to include deviations in such shape. For example, regions of the transfer functions 970*r* and 970*b* illustrated or described as being rectangular will, typically, have rounded or curved features. Thus, the transfer functions 970*r* and 970*b* illustrated in the figures are schematic in nature and their shapes are not intended to illustrate the precise shape of such transfer functions and are not intended to limit the scope of the invention.

Referring now to FIGS. 9A-9D, the shutter controller 910 may be configured to activate the first and/or second liquid crystal shutters 920*r* and/or 920*b* to the open and/or closed states to improve efficiency in generating the first and/or second image component based on the filtering characteristics of the color filters 930*r* and 930*b*. For example, as both of the color filters 930*r* and 930*b* may allow passage of the green light 999*g*, the shutter controller 910 may activate both liquid crystal shutters 920*r* and 920*b* to simultaneously display the green color image data, which may improve brightness and/or efficiency. In contrast, if the color filter 930*r* were configured to allow passage of red light 999*r* and prevent passage of both blue light 999*b* and green light 999*g*, the shutter controller 910 may be configured to activate only the second liquid crystal shutter 920*b* to display the green color image data.

The shutter controller 910 may also be configured to accelerate a shutter rate of the first and second shutters 920*r* and 920*b* to provide a predetermined refresh rate for the displayed image. More particularly, as the LCD screen 900 is configured to sequentially display two image components in sequence in order to provide a single image, the shutter controller 910 may increase the shutter rate of the liquid crystal shutters 920*r* and/or 920*b* by a factor of two in order to maintain a refresh rate comparable to that of a conventional LCD device.

Figure 9E:
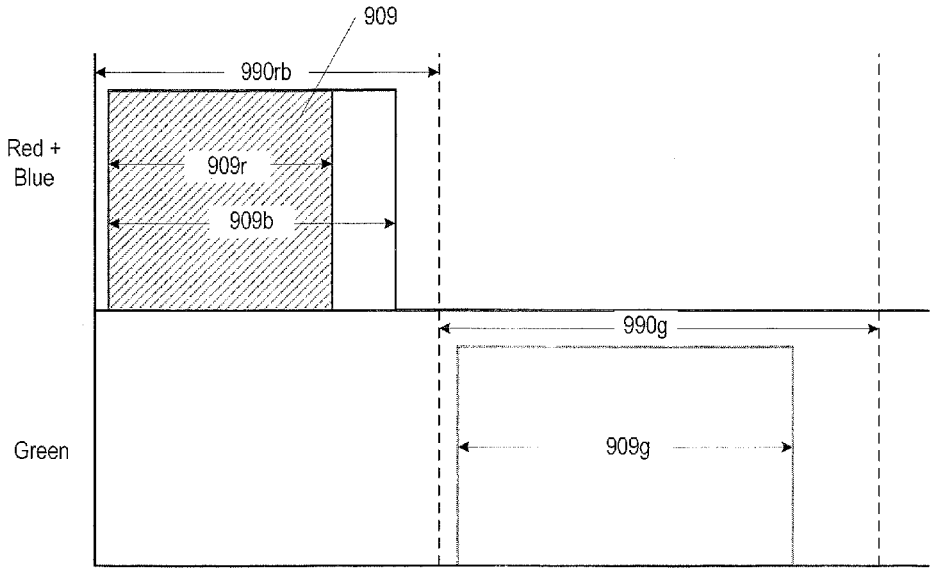

FIG. 9E is a graph illustrating the relative on-periods for red, blue, and green light emitted by a backlight (also referred to herein as duty cycles) relative to an image refresh period in accordance with some embodiments of the present invention. Referring now to FIG. 9E, the image refresh period is divided into a first time period 990*rb* and a second time period. The backlight controller is configured to activate the backlight to emit the first and second colors of light during the first time period 990*rb*, and is configured to activate the backlight to emit the third color of light during a second time period 990*g*. More particularly, the backlight controller is configured to activate the backlight to emit red and blue light during the first time period 990*rb*, and to emit green light during the second time period 990*g*. For example, where the backlight includes red, blue, and green solid state light emitting elements, such as LEDs, the backlight controller may be configured to turn on the red and blue LEDs and turn off the green LEDs during the first time period 990*rb*. Similarly, the backlight controller may be configured to turn on the green LEDs and turn off the red and blue LEDs during the second time period 990*g*. However, the backlight controller may not activate the backlight for the entire duration of the first and/or second time periods 990*rb* and 990*g*. In addition, in some embodiments, the first and second time periods 990*rb* and 990*g* may not have the same duration. For example, the first time period may have a duration of 6.67 ms, while the second time period may have a duration of 10 ms, for an image refresh period of about 16.67 ms (i.e., a refresh rate of about 60 Hz). In other embodiments, however, the first and second time periods 990*rb* and 990*g* may be substantially equal in duration. The duty cycles of the different colors of light within the first and/or second time periods 990*rb* and 990*g* may or may not be the same, as discussed in detail below.

Still referring to FIG. 9E, the backlight controller is configured to activate the backlight to emit red light during a first portion 909*r* of the first time period 990*rb*, and to emit blue light during a second portion 909*b* of the first time period 990*rb*. In some embodiments, the first portion 909*r* and the second portion 909*b* of the first time period 990*rb* may be of a substantially equal duration, that is, the backlight may be activated to emit red light and blue light substantially simultaneously. In other embodiments, however, the first portion 909*r* and the second portion 909*b* of the first time period 990*rb* may be of different durations that at least partially overlap during a portion of the first time period 990*rb*. As such, the backlight controller may activate the backlight to emit red and blue light at a same time (illustrated as shaded portion 909) during the first time period 990*rb* despite different durations of activation for the individual red and blue LEDs. Likewise, the backlight controller may activate the backlight to emit green light during a portion 909*g* of the second time period 990*g* that does not overlap with activation of the red and blue light during the portions 909*r* and 909*b* of the first time period 990*rb*. As such, the backlight controller may activate the backlight to emit red and blue light at the same time 909 and emit green light at a different time 909*g* in coordination with the liquid crystal shutters 920*r* and 920*b* of the first and second subpixels 918*r* and 918*b* to sequentially display the first and second image components. The duration(s) of activation for the red and blue light within the first time period 990*rb* and the green light within the second time period 990*g* (and the corresponding duration(s) of activation of the shutters 920*r* and 920*b*) may be adjusted to provide an image with a desired white point.

The refresh rate of the LCD device 900 is based on the sum of the first and second time periods 990*rb* and 990*g*. Accordingly, in comparison with a conventional filterless liquid crystal display that is configured to sequentially display first, second, and third image components to provide an image, a two-subpixel liquid crystal device according to some embodiments of the present invention may provide a refresh rate that is increased by about 33%, as only two image components may be displayed to provide each image.

In addition, in comparison with a conventional three-subpixel approach, LCD devices according to some embodiments of the present invention may offer reduced power consumption. For example, the light power of each color passing through an LCD can be expressed as follows:

$$P_{R,LCD} = \frac{\eta_{LCD}\eta_{R,filter}P_R DC_R}{\eta_{sp}} \tag{1}$$

$$P_{G,LCD} = \frac{\eta_{LCD}\eta_{G,filter}P_G DC_G}{\eta_{sp}} \tag{2}$$

$$P_{B,LCD} = \frac{\eta_{LCD}\eta_{B,filter}P_B DC_B}{\eta_{sp}} \tag{3}$$

where $P_{K,\ LCD}$ (K=R, G, B) is a light power of each color passing through the LCD panel, $\eta_{LCD}$ is the LCD efficiency, $\eta_{K,filter}$ is a filter transmittance of each color, $P_K$ is the backlight power of each color (when on), $\eta_{sp}$ is the number of subpixels, and $DC_R$ is the duty cycle of each color. The power consumption for each color may be expressed by the following equations:

$$P_R DC_R = \frac{\eta_{sp}P_{R,LCD}}{\eta_{LCD}\eta_{R,filter}} \tag{4}$$

$$P_G DC_G = \frac{\eta_{sp}P_{G,LCD}}{\eta_{LCD}\eta_{G,filter}} \tag{5}$$

$$P_B DC_B = \frac{\eta_{sp}P_{B,LCD}}{\eta_{LCD}\eta_{B,filter}} \tag{6}$$

The total power consumption may therefore be expressed as follows:

$$P=P_R DC_R+P_G DC_G+P_B DC_B \tag{7}$$

Accordingly, for a two-subpixel LCD device according to some embodiments of the present invention (such as the LCD device 800 of FIGS. 8A-8B), the total power consumption may be expressed as:

$$P = \frac{2}{\eta_{LCD}}\left[\frac{P_{R,LCD}}{\eta_{R,RGfilter}} + \frac{P_{G,LCD}}{\eta_{G,RGfilter}+\eta_{B,RGfilter}} + \frac{P_{B,LCD}}{\eta_{B,BGfilter}}\right] \tag{8}$$

In addition, for a partially filterless LCD device according to some embodiments of the present invention (such as the LCD device 200 of FIGS. 2A-2B), the total power consumption may be expressed as:

$$P = \frac{3}{\eta_{LCD}}\left[\frac{P_{R,LCD}}{\eta_{R,filter}} + P_{G,LCD} + \frac{P_{B,LCD}}{\eta_{B,filter}}\right] \tag{9}$$

In contrast, the total power consumption for a conventional three-subpixel LCD device may be expressed as:

$$P = \frac{3}{\eta_{LCD}}\left[\frac{P_{R,LCD}}{\eta_{R,filter}} + \frac{P_{G,LCD}}{\eta_{G,filter}} + \frac{P_{B,LCD}}{\eta_{B,filter}}\right] \tag{10}$$

Also, for a conventional filterless LCD device configured to sequentially display three image components per frame, the total power consumption may be expressed as:

$$P = \frac{P_{R,LCD}+P_{G,LCD}+P_{B,LCD}}{\eta_{LCD}} \tag{11}$$

Thus, power consumption for LCD devices according to some embodiments of the present invention may be reduced by up to about 50% in comparison with conventional LCD devices.

Although FIGS. 9A to 9E illustrate an exemplary LCD screen and related elements according to some embodiments of the present invention, it will be understood that some embodiments of the present invention are not limited to such a configuration, but are intended to encompass any configuration capable of carrying out the operations described herein. For example, although the LCD screen 900 is illustrated as being configured to display red, green, and blue color image data using a red/green and a blue/green subpixel, it is to be understood that the LCD screen 900 may use any combination of two subpixels that are configured to display three colors of light. For example, in some embodiments, a red subpixel including a color filter that allows passage of red light but prevents passage of blue and green light may be used in conjunction with a blue/green subpixel including a color filter that allows passage of blue and green light but prevents passage of red light. In addition, although discussed above with reference to red, blue, and green filters, other color filters may be used as well. For example, the LCD screen 900 may be configured to display magenta, yellow, and cyan light using only a magenta/yellow and a cyan/yellow subpixel. More generally, according to some embodiments of the present invention, the LCD screen 900 may be configured to display three colors of light using two subpixels.

Figure 10:
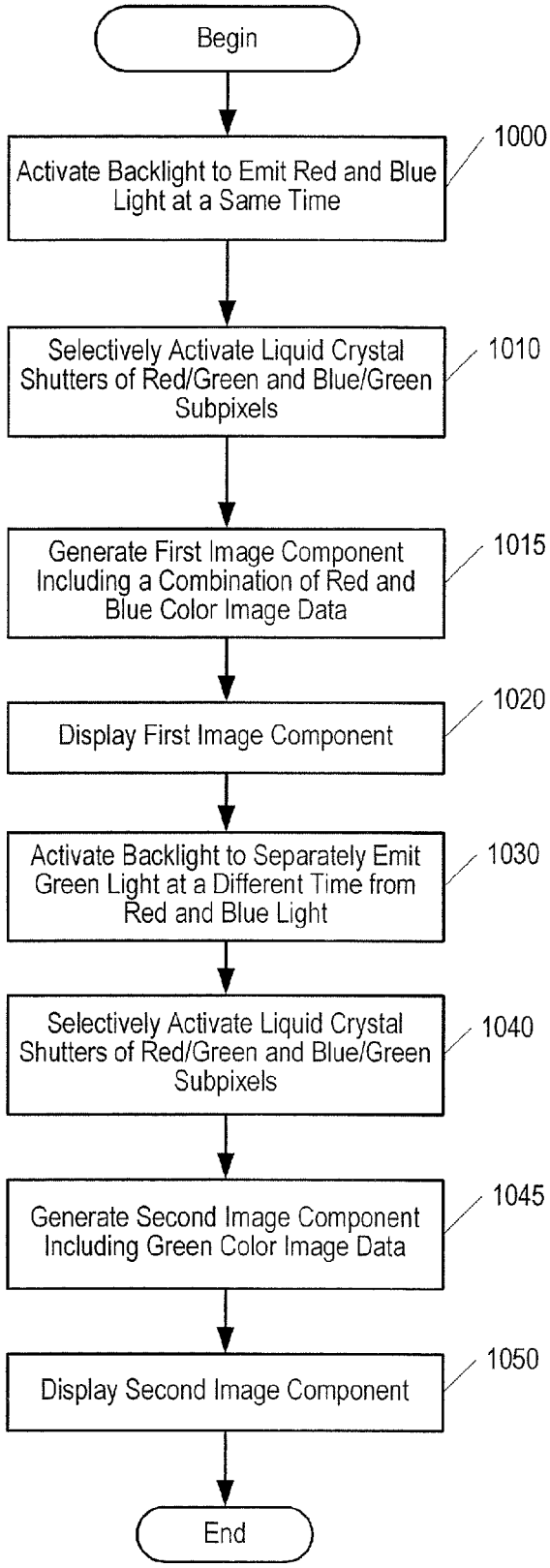
FIG. 10 is a flowchart illustrating operations that may be performed by an LCD device according to further embodiments of the present invention.

FIG. 10 is a flowchart illustrating more detailed operations that may be performed by a liquid crystal display device including a backlight and a pixel array according to further embodiments of the present invention. Referring now to FIG. 10, operations begin at Block 1000 when the backlight is activated to emit red and blue light at a same time. For example, the backlight may include red, blue, and green solid state lighting elements, such as LEDs, and the red and blue lighting elements may be activated substantially simultaneously to emit the red and blue light during at least partially overlapping time periods. Concurrently, at Block 1010, the liquid crystal shutters associated with the red/green and blue/green subpixels of each pixel of the pixel array are selectively activated. As such, the red/green color filters associated with the red/green subpixels may allow passage of the red light and prevent passage of the blue light, while blue/green color filters associated with the blue/green subpixels may allow passage of the blue light and prevent passage of the red light.

Accordingly, red color image data displayed by the red/green subpixels and blue color image data displayed by the blue/green subpixels may be combined to generate a first image component at Block 1015. The first image component including the combination of the red and blue color image data is displayed by the pixel array at Block 1020.

Still referring to FIG. 10, the backlight is activated to separately emit green light at a different time than red and blue light at Block 1030. For example, where the backlight includes red, blue, and green solid state lighting elements, the green solid state lighting element may be activated at a different time than the red and blue solid state lighting elements to emit the green light separately from the red and blue light. Concurrently, at Block 1040, the liquid crystal shutters associated with the red/green subpixels and/or the blue/green subpixels are selectively activated to allow passage of the green light. Thus, a second image component including green color image data is generated at Block 1045. The second image component including the green color image data is displayed by the pixel array at Block 1050.

Accordingly, as illustrated in FIG. 10, first and second subpixels of each pixel in the pixel array may be selectively activated when the backlight is activated to emit first and second colors of light at a same time to generate a first image component, and the first and second subpixels of each pixel of the pixel array may be selectively activated when the backlight is activated to separately emit a third color of light at a different time than the first and second colors to generate a second image component. The first and second image components may be sequentially displayed to provide a single image frame.

The operations of FIG. 10 may be performed to activate the pixel array and the backlight to sequentially display the first image component and the second image component in rapid succession, such that a single full-color image frame may be perceived by a viewer. As such, the rate at which the pixel array may sequentially display the first and second image components may be dependent on the switching speed of the liquid crystal shutters and/or the lighting elements of the backlight. For instance, to sequentially display the first and second image components at an image refresh rate comparable to that of a conventional liquid crystal display, a shutter rate of the liquid crystal shutters may be accelerated. More specifically, to provide each two-image sequence, the shutter rate of the liquid crystal shutters may be doubled. As the switching rate of the lighting elements of the backlight may be significantly faster than the shutter rate of the liquid crystal shutters, the backlight may be activated based on the shutter rate of the liquid crystal shutters. As such, in some embodiments, the refresh rate of the LCD device may be dependent on a maximum shutter rate of the liquid crystal shutters.

The flowchart of FIG. 10 illustrates exemplary operations of some solid state lighting devices and/or liquid crystal display devices according to embodiments of the present invention. In this regard, each block may represent a module, segment, or portion of code, which may comprise one or more executable instructions for implementing the specified logical functions. It should also be noted that in other implementations, the functions noted in the blocks may occur out of the order noted in the figures. For example, two blocks shown in succession may, in fact, be executed substantially concurrently, or the blocks may sometimes be executed in the reverse order, depending on the functionality involved. More particularly, although the flowchart of FIG. 10 illustrates generating and/or displaying the first image component prior to the second image component, it is to be understood that the blocks may be executed such that the second image component is generated and/or displayed prior to the first image component. Also, although illustrated in FIG. 10 with reference to red/green and blue/green subpixels, it is to be understood that any combination of two subpixels that are configured to allow passage of three colors of light may be used, such as a red subpixel in combination with a blue/green subpixel, a blue subpixel in combination with a red/green subpixel, a magenta subpixel in combination with a cyan/yellow subpixel, etc.

As noted above, partially filterless and/or two subpixel LCD devices according to some embodiments of the present invention may offer reduced power consumption in comparison to conventional LCD devices. For example, the theoretical limit for color filterless and/or other known LCD devices may be about 50% efficiency. With a partially filterless LCD device having no green color filter and relatively wide red and blue color filters according to some embodiments of the present invention, an actual efficiency of up to about 35 to 40% may be achieved. In contrast, conventional mobile LCD displays with white backlights (such as cold cathode fluorescent lamps and/or white LEDs), may achieve only about 15% actual transmittance.

Accordingly, partially filterless and/or two subpixel LCD devices according to some embodiments of the present invention may be of particular use in mobile electronic devices, also referred to herein as mobile terminals. For example, mobile electronic devices may include notebook, laptop, and/or palmtop computers; personal digital assistants (PDAs); personal identification managers (PIMs); cell phones; smart phones; Personal Communications System (PCS) terminals that may combine a cellular radiotelephone with data processing, facsimile and data communications capabilities; portable music players; and/or other portable devices including a display that relies on a portable power source (such as a battery and/or a fuel cell). Such mobile electronic devices may require relatively high peak luminance (for example, for sunlight readability); however, viewing angle and/or refresh rates may not be as important in such devices (with possible exceptions for laptops and/or portable video players).

Figure 11:
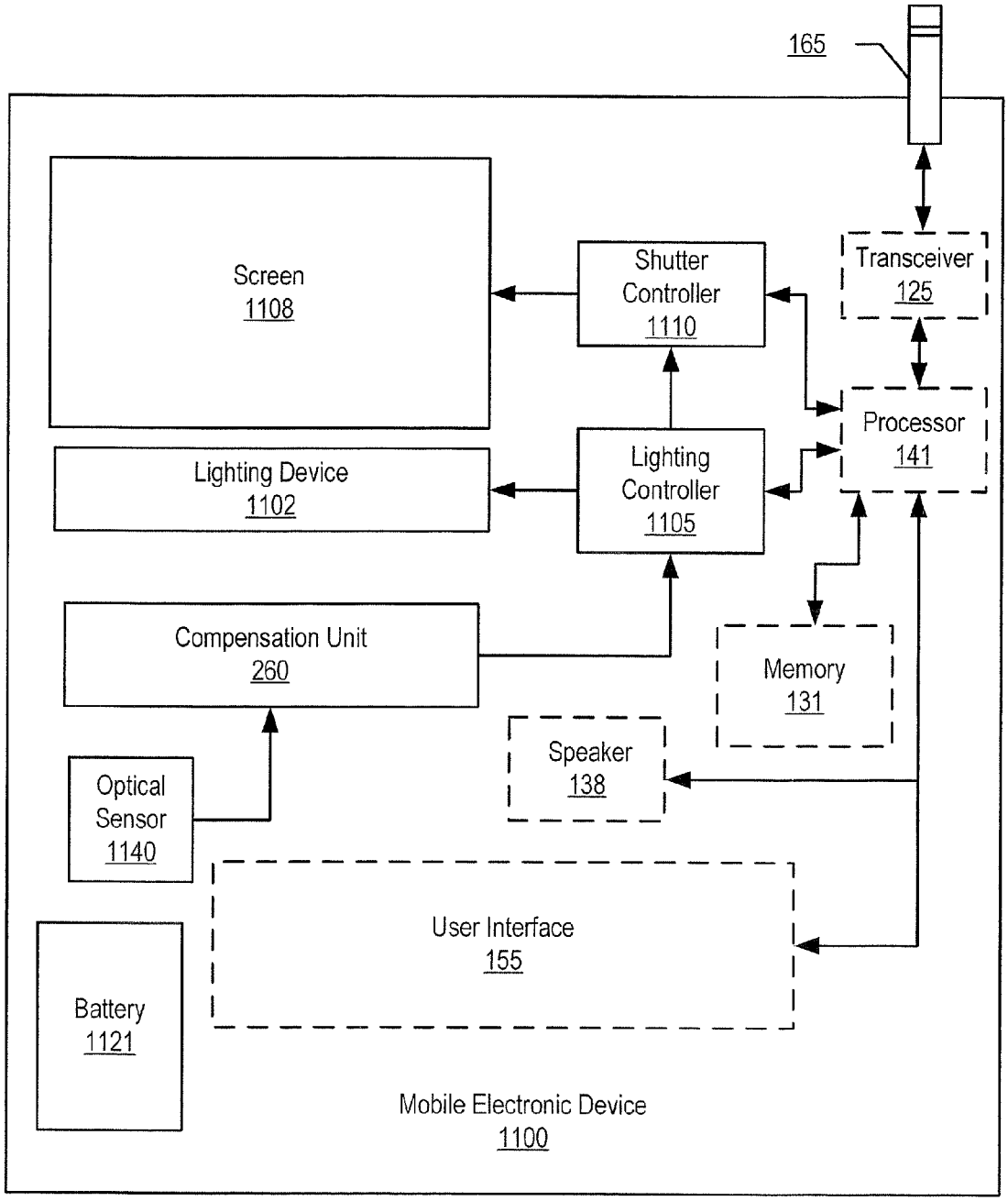
FIG. 11 is a block diagram illustrating a mobile electronic device including LCD devices and methods of operation according to some embodiments of the present invention.

FIG. 11 illustrates a mobile electronic device 1100 including liquid crystal display devices according to some embodiments of the present invention. Referring now to FIG. 11, the mobile electronic device 1100 includes a lighting panel 1102, a lighting controller 1105, a screen 1108, a shutter controller 1110, and a power source, such as a battery 1121. The screen 1108 may be an LCD screen, such as the partially filterless LCD screen 208 of FIGS. 2A-2B or the two-subpixel LCD screen 808 of FIGS. 8A-8B. Likewise, the lighting device 1102 may be a backlight for an LCD display, such as the backlight 202 of FIGS. 2A-2B and/or the backlight 802 of FIGS. 8A-8B. In some embodiments, the mobile electronic device 1100 may also include a wireless transceiver 125, a memory 131, a speaker 138, a processor 141, an antenna 165, and/or a user interface 155, depending on the particular functionalities of the mobile electronic device 1100.

The lighting controller 1105 includes circuitry that is configured to activate or energize the lighting panel 1102. More particularly, the lighting controller 1105 may be configured to provide independent current control for individual LED strings of the lighting device 1102, for example, to activate the red and blue LEDs of the lighting device 1102 to emit red and blue light at the same time and to activate the green LEDs of the lighting device 1102 to separately emit green light at a different time. The shutter controller 1110 includes circuitry that is configured to address pixels and/or subpixels of the screen 1108 to open and/or close particular liquid crystal shutters in coordination with activation of the lighting device 1102. The battery 1121 is configured to provide power to the various elements of the mobile electronic device 1100. As such, the mobile electronic device may further include a DC/DC converter (not shown), such as a boost converter, to generate supply voltages for internal circuits that may require different voltages than the voltage provided by the battery 1121. For example, the DC/DC converter may be included in the lighting controller 1105.

The lighting device 1102 may be a solid state lighting device, such as the lighting panel 300 of FIG. 3A, and as such, may include a plurality of bar assemblies 330 including a plurality of tiles 312, as described above. However, it will be appreciated that embodiments of the invention may be employed in conjunction with lighting panels formed in other configurations. For example, in some embodiments of the present invention, the lighting device 1102 may be an edge backlight positioned along at least one side of the screen 1108. As such, the mobile electronic device 1100 may further include a light guide (not shown) adjacent to the screen 1108 that is configured to distribute light output by the edge backlight to the screen 1108. In other embodiments, the lighting device 1102 may be a direct backlight including a plurality of bar assemblies arranged to form a two-dimensional lighting panel that is positioned adjacent to and behind the screen 1102.

Still referring to FIG. 11, the mobile electronic device 1100 further includes one or more optical sensors 1140 and a compensation unit 1160. The optical sensor 1140 may be configured to detect ambient light in the current operating environment of the mobile electronic device 1100, and the compensation unit 1160 may be configured to reduce or increase the light output of the lighting device 1102 accordingly. More particularly, sensor outputs from the optical sensor 1140 may be provided to the compensation unit 1160, which may be configured to sample the outputs and to provide the sampled values to the lighting controller 1105 to control the power provided to the lighting device 1102 based on the detected ambient light. For example, the lighting controller 1105 may include a plurality of registers configured to store pulse width information for the LED strings of the screen 1108. The initial values in the registers may be determined by an initialization/calibration process. However, the register values may be adaptively changed over time based on, for example, input from the optical sensor 1140 coupled to the compensation unit 1160. As such, the optical sensor 1140 may generate a feedback signal that may be used by the color management compensation unit 1160 to adjust the register values for corresponding LED strings of the lighting device 1102. In some embodiments, the optical sensor 1140 may also include a temperature sensor configured to provide temperature information to the compensation unit 1160 and/or the lighting controller 1105, which may adjust the light output from the lighting device 1102 based on known and/or predicted brightness vs. temperature operating characteristics of the LEDs of the lighting device 1102.

Accordingly, the sensor 1140, the lighting controller 1105, and the compensation unit 1160 form a closed loop feedback control system for controlling the light output of the lighting device 1102. The feedback control system may be utilized to maintain the output of the lighting device 1102 at a desired luminance, chromaticity, and/or color temperature. For example, in some embodiments, the lighting device 1102 may be operated to provide a luminance greater than about 100 Nit and/or a luminance-to-power ratio of greater than about 20 Nit per Watt, for instance, for a 15-inch display. Although the compensation unit 1160 is illustrated as a separate element, it will be appreciated that the functionality of the compensation unit 1160 may, in some embodiments, be performed by another element, such as the lighting controller 1105.

The optical sensor 1140 may be positioned at various locations within the mobile electronic device 1100 in order to obtain representative sample data. For example, the optical sensor 1140 may be positioned on an external surface of the mobile electronic device 1100. Also, the optical sensor 1140 may be positioned internally behind a surface of the screen 1108, and may be configured to detect ambient light through the screen 1108. Additionally, light guides (such as optical fibers) may be provided in the mobile electronic device 1100 to provide light from different locations to the optical sensor 1140. In some embodiments, the optical sensor 1140 may be configured to sample ambient light levels when the lighting device 1102 is not activated. For example, with reference to FIG. 9E, the optical sensor 1140 may sample ambient light levels at the end of the first time period 990*rb* when neither the first and second colors of light nor the third color of light are emitted by the lighting device.

Accordingly, LCD devices according to some embodiments of the present invention may consume about 40% to about 50% of the power of more efficient conventional LCD backlights, and as low as about 25 to 30% of the power of less efficient conventional LCD backlights. In addition, superior color gamut may be provided (for example, based on the detected ambient light), which may improve apparent contrast and/or brightness for displayed images having a relatively wide range of saturated colors. As such, LCD devices according to some embodiments of the present invention may provide a color gamut in excess of 100% of the National Television Standards Committee (NTSC) standard (for example, about 105% of NTSC), in contrast to conventional high-efficiency LCD displays, which may provide a gamut lower than about 70% of NTSC. Thus, mobile electronic devices including partially color filterless and/or two-subpixel LCD devices according to some embodiments of the present invention (and appropriately synchronized video sequencing) may provide improved net LCD transmission efficiency.

In the drawings and specification, there have been disclosed typical embodiments of the invention, and, although specific terms are employed, they are used in a generic and descriptive sense only and not for purposes of limitation, the scope of the invention being set forth in the following claims.

That which is claimed:

1. A liquid crystal display device, comprising:

a backlight configured to emit first and second colors of light; and a backlight controller configured to activate the backlight to emit the first and second colors of light at a same time, wherein the backlight controller is configured to activate the backlight to emit the first color of light for a first duration of time, and wherein the backlight controller is configured to activate the backlight to emit the second color of light for a second duration of time different than the first duration of time, wherein the first and second durations of time overlap.

2. The device of claim 1, wherein the backlight controller is configured to activate the backlight to emit the first color of light for the first duration during a first portion of a first time period, and to emit the second color of light for the second duration during a second portion of the first time period, wherein the first and second portions of the first time period overlap and respectively include the same time.

3. The device of claim 2, wherein:

the backlight is further configured to emit a third color of light;

the backlight controller is configured to activate the backlight to emit the first and second colors of light at the same time during the first time period to generate a first image component including a combination of first color image data and second color image data; and the backlight controller is configured to activate the backlight to separately emit the third color of light during a second time period that does not overlap with the first time period to generate a second image component including the third color image data.

4. The device of claim 3, wherein the respective durations of activation for the first and second colors of light within the first time period and the third light within the second time period are selected such that the first and second image components provide an image with a desired white point.

5. The device of claim 3, further comprising:

a pixel array including a plurality of pixels configured to display an image, wherein the plurality of pixels respectively comprise:

a first subpixel configured to display the first color image data; and a second subpixel configured to display the second and third color image data, wherein the pixel array is configured to sequentially display the first and second image components to provide a single image frame.

6. A liquid crystal display device, comprising:

a backlight configured to emit first, second, and third colors of light; and a backlight controller configured to activate the backlight to emit the first and second colors of light at a same time to generate a first image component including a combination of first color image data and second color image data, and to separately emit the third color of light at a different time than the first and second colors of light to generate a second image component including the third color image data, wherein the backlight controller is configured to activate the backlight to emit at least two of the first, second, and third colors of light for different durations.

7. The device of claim 6, further comprising:

a pixel array including a plurality of pixels configured to display an image, wherein the plurality of pixels respectively comprise:

a first subpixel configured to display the first color image data; and a second subpixel configured to display the second and third color image data, wherein the pixel array is configured to sequentially display the first and second image components to provide a single image frame.

8. The device of claim 7, wherein the first subpixel comprises a first liquid crystal shutter configured to be activated to an open state and a closed state and a first color filter configured to allow passage of a first color of light and prevent passage of a second color of light, and wherein the second subpixel comprises a second liquid crystal shutter configured to be activated to an open state and a closed state and a second color filter configured to allow passage of the second color of light and a third color of light and prevent passage of the first color of light.

9. The device of claim 8, wherein the first subpixel is configured to display the first and the third color image data, and wherein the first color filter is further configured to allow passage of the third color of light.

10. The device of claim 8, further comprising:

a shutter controller configured to selectively activate the first and second liquid crystal shutters when the backlight is activated to emit the first and second colors of light to display the first color image data and the second color image data at the same time to generate the first image component, and configured to selectively activate at least the second liquid crystal shutter when the backlight is activated to separately emit the third color of light to separately display the third color image data at the different time to generate the second image component.

11. The device of claim 6, wherein the backlight controller is configured to alternately activate the backlight to emit the first and second colors of light at the same time and activate the backlight to emit the third color of light at the different time than the first and second colors of light to sequentially display the first and second image components at a predetermined refresh rate.

12. The device of claim 11, wherein the predetermined refresh rate is based on a shutter rate of the first and/or second liquid crystal shutters.

13. The device of claim 6, wherein the backlight controller is configured to activate the backlight to emit the first and second colors of light during a first time period, and wherein the same time comprises at least a portion of the first time period.

14. The device of claim 13, wherein the backlight controller is configured to activate the backlight to emit the first color of light during a first portion of the first time period and emit the second color of light during a second portion of the first time period, wherein the first and second portions of the first time period have the different durations but respectively include the same time.

15. The device of claim 13, wherein the backlight controller is configured to activate the backlight to emit the third color of light during a second time period, and wherein a duration of the second time period is different than that of the first time period.

16. The device of claim 6, wherein the backlight comprises a solid state lighting panel comprising:

a first solid state lighting element configured to emit the first color of light;

a second solid state lighting element configured to emit the second color of light; and a third solid state lighting element configured to emit the third color of light;

wherein the backlight controller is configured to activate the first and second solid state lighting elements at the same time to generate the first image component, and to activate the third solid state lighting element at the different time than the first and second solid state lighting elements to generate the second image component.

17. The device of claim 16, wherein the first, second, and/or third solid state lighting elements comprise a light-emitting diode (LED), an organic light-emitting diode (OLED), and/or a laser light source.

18. The device of claim 6, further comprising:

a battery electrically coupled to the pixel array and the backlight and configured to provide power thereto.

19. The device of claim 8, wherein a wavelength of the third color of light is greater than a wavelength of the second color of light but less than a wavelength of the first color of light.

20. The device of claim 19, wherein the first color of light comprises red light, wherein the second color of light comprises blue light, and wherein the third color of light comprises green light.

* * * * *